US007575367B2

(12) United States Patent
Wolf, V et al.

(10) Patent No.: US 7,575,367 B2
(45) Date of Patent: Aug. 18, 2009

(54) CONTROLLABLE WATCH WINDER FOR SELF-WINDING WATCHES

(75) Inventors: Simon P. Wolf, V, Malibu, CA (US); Tony Ming Sang Ng, Kowloon (HK)

(73) Assignee: Wolf Designs, Inc., Los Angeles, CA (US)

( * ) Notice: Subject to any disclaimer, the term of this patent is extended or adjusted under 35 U.S.C. 154(b) by 371 days.

(21) Appl. No.: 10/845,463

(22) Filed: May 12, 2004

(65) Prior Publication Data

US 2005/0254352 A1 Nov. 17, 2005

(51) Int. Cl.
*G04B 3/00* (2006.01)
*G04D 3/00* (2006.01)

(52) U.S. Cl. ..... 368/206; 81/7.5

(58) Field of Classification Search ..... 368/206–210, 368/216; 81/7.5; 318/280, 293
See application file for complete search history.

(56) References Cited

U.S. PATENT DOCUMENTS

| | | | | |
|---|---|---|---|---|
| 2,588,042 | A | 3/1952 | Poltrock | |
| 2,863,345 | A | 12/1958 | Fiechter | |
| 2,917,955 | A | 12/1959 | Leger | |
| 2,926,519 | A | 3/1960 | Setterberg | |
| 3,620,007 | A | 11/1971 | Kauffman | |
| 4,057,958 | A * | 11/1977 | Wuntch | 368/207 |
| 4,988,931 | A * | 1/1991 | Tsukahara et al. | 318/293 |
| 5,608,693 | A | 3/1997 | Richards | |
| 5,988,871 | A * | 11/1999 | Bonnet | 368/206 |
| D440,583 | S | 4/2001 | Greene, Jr. | |
| 6,254,270 | B1 * | 7/2001 | Agnoff | 368/206 |
| D452,256 | S | 12/2001 | Wolf | |
| D455,449 | S | 4/2002 | Siu | |
| 6,439,761 | B1 | 8/2002 | Agnoff | |
| 6,543,929 | B1 * | 4/2003 | Agnoff | 368/206 |

(Continued)

FOREIGN PATENT DOCUMENTS

DE 195 35 229 A1 4/1997

(Continued)

OTHER PUBLICATIONS

"New Time Zone Sponsor: Primadyne's SoftWind" from the Web site printout of Jul. 1, 2004 at http://www.forums.timezone.com (2 pages).

(Continued)

*Primary Examiner*—Edwin A. Leon
*Assistant Examiner*—Thanh S Phan
(74) *Attorney, Agent, or Firm*—Fulwider Patton LLP

(57) ABSTRACT

A controllable watch winder for a self-winding mechanical watch, in which a turntable is provided to hold and rotate the watch, including a programmable microprocessor circuit configured to count the number of rotations executed by the turntable. In one aspect, the watch winder is configured to introduce, after the electronic circuit is activated, a delay period before the turntable commences rotating. In another aspect, the circuit may be configured to interrupt the rotation of the turntable with pauses, to break up the rotation into cyclical sets. The circuit may be configured to automatically predetermine the number of rotations in each set. In yet another aspect, the watch winder may be configured to be manually adjustable, to variably predetermine before use, the number of rotations to be executed by the turntable and the length of any pause between rotations.

57 Claims, 19 Drawing Sheets

U.S. PATENT DOCUMENTS

| | | | | |
|---|---|---|---|---|
| D474,216 | S | 5/2003 | Siu | |
| D492,952 | S | 7/2004 | Siu | |
| 6,910,802 | B2 * | 6/2005 | Rustioni | 368/206 |

FOREIGN PATENT DOCUMENTS

| | | | |
|---|---|---|---|
| EP | 0 846 988 | A2 | 6/1998 |
| GB | 2 233 477 | A | 1/1991 |
| IT | 91-2629 | | 10/1991 |
| JP | 10-197654 | | 7/1998 |
| WO | WO 01/71435 | A1 | 9/2001 |

OTHER PUBLICATIONS

"SoftWind Variable Geometry Watch Winding Machines" from the Web site printout of Jul. 1, 2004 at http://www.primadyne.com (16 pages).
Various advertisements for watch winders from pp. 77-78 and 87 from an issue of *Sky Mall* magazine (date unknown).
"Review of the Everwell Two-Watch Winder" from the Web site printout of Aug. 30, 2004 at http://www3.watchwinder.com (6 pages).
"Eilux Wood Watch Winder Review" from the Web site printout of Aug. 30, 2004 at http://www3.watchwinder.com (7 pages).
"Welcome to Everwell Instruments Ltd." from the Web site printout of Aug. 30, 2004 at http://www3.watchwinder.com (8 pages).
"Select Winding Direction" Chart from the Web site printout of Aug. 30, 2004 at http://www3.watchwinder.com (3 pages).
"Standard Packaging" from the Web site printout of Aug. 30, 2004 at http://www3.watchwinder.com (4 pages).
"Technology Info" from the Web site printout of Aug. 30, 2004 at http://www3.watchwinder.com (4 pages).
"Everwell Single-Watch Winder Review" from the website printout of Aug. 30, 2004 at http://www3.watchwinder.com (1 page).
"Product Highlights" from the Web site printout of Aug. 30, 2004 at http://www3.watchwinder.com (3 pages.
"About Our Company—Everwell Instruments Ltd."from the Web site printout of Aug. 30, 2004 at http://www3.watchwinder.com (3 pages).
"Why Do You Need A Watch Winder?" from the Web site printout of Aug. 30, 2004 at http://www3.watchwinder.com (4 pages).
"Fuzzy Logic Watch Winding Machine" from the Web site printout of Aug. 30, 2004 at http://www3.watchwinder.com (5 pages).
"Fuzzy Logic Automatic Watch Winder" from the Web site printout of Aug. 30, 2004 at http://www3.watchwinder.com (8 pages).
"A Bunch of Information on Watch Winders" from the Web site printout of May 5, 2004 at http://www.timezone.com (12 pages).
"Review on the MTE WTB 220 winder" from the Web site printout of May 5, 2004 at http://www.forums.timezone.com (3 pages).
"Automatic Watch Winders" from the Web site printout of May 5, 2004 at http://www.superiorwatch.com (7 pages).
"Watch Winders" from the Web site printout of May 5, 2004 at http://www.swissrepairs.com (3 pages).
"Scatola del Tempo—About Us" from the Web site printout of May 3, 2004 at http://www.scatoladeltempo.com (3 pages).
"Watch Winders & Accessories: Scatola del Tempo Watch Winders for Sale!" from the Web site printout of May 3, 2004 at http://www.watchnetwork.com (12 pages).
"Comments—On Review of Scatola Del Tempo 7RT Watch Winder" from the Web site printout of May 3, 2004 at http://www.greenspun.com (2 pages).
"Scatola Del Tempo 7RT Review" from the Web site printout of May 3, 2004 at http://www.fullyvested.com (5 pages).
"Watch Winders: Frequently Asked Questions" from the Web site printout of May 3, 2004 at http://www.superiorwatch.com (7 pages).
Excerpt pp. 12-15, 21, 88 and 89 from the brochure of Scatola del Tempo (date unknown).
"Watchwinders.com—Affordable Watch Winders, Accessories and Rare Watches" from the Web site printout of May 24, 2004 at http://www.watchwinders.com (2 pages).
"Watchwinders.com—Affordable Watch Winders, Accessories and Rare Watches" from the Web site printout of May 24, 2004 at http://www.watchwinders.com (3 pages).
"MTE—Watchwinders for I und 2 Watches" from the Web site printout of May 24, 2004 at http://www.mte-motors.de (7 pages).
"MTE—Distributors for Watchwinders" from the Web site printout of May 24, 2004 at http://www.mte-motors.de (2 pages).
"MTE—WTM-Technical Data:" from the Web site printout of May 24, 2004 at http://www.mte-motors.de (4 pages).
"MTE: WTM-Einbaumodul/-installation module" from the Web site printout of May 24, 2004 at http://www.mte-motors.de (2 pages).
"MTE—Watchwinders" from the Web site printout of May 24, 2004 at http://mte-motors.de (2 pages).
"MTE—Service Uhrenbeweger" from the Web site printout of May 24, 2004 at http://mte-motors.de (1 page).
"MTE—Kaufberatung" from the Web site printout of May 24, 2004 at http://mte-motors.de (1 page).
"Watch Winder Outlet Mall" from the Web site printout of May 25, 2004 at http://www.afrodablewatchwinders.com (9 pages).
"About Us from James Feldman" from the Web site printout of May 25, 2004 at http://www.watchwinders.com (3 pages).
"Welcome to Orbita" from the Web site printout of May 18, 2004 at http://www.orbita.net (2 pages).
"How It All Began" from the Web site printout of May 18, 2004 at http://www.orbita.net (1 page).
"Winder Collection" from the Web site printout of May 18, 2004 at http://www.orbita.net (1 page).
"Winders for 1 Watch" from the Web site printout of May 18, 2004 at http://www.orbita.net (2 pages).
"Winding Patek's Sky Moon" from the Web site printout of May 18, 2004 at http://www.orbita.net (2 pages).
"No More Winding" from a Web site printout of May 18, 2004 at http://www.orbita.net (1 page).
"Press Release No. 124" from a Web site printout of May 18, 2004 at http://www.orbita.net (1 page).
"Support Section" from a Web site printout of May 25, 2004 at http://www.orbita.net (1 page).
"Watchwinder Basics" from a Web site printout of May 25, 2004 at http://www.orbita.net (2 pages).
"Watchwinder Comparisons" from the Web site printout of May 25, 2004 at http://www.orbitan.net (2 pages).
"Questions & Answers" from the Web site printout of May 25, 2004 at http://www.orbita.net (3 pages).
"Standard Operation" from the Web site printout of May 25, 2004 at http://www.orbita.net (4 pages).
"Bellino Operation" from the Web site printout of May 25, 2004 at http://www.orbita.net (2 pages).
"Watch Rotator Instructions" from a watch winder sold by Wolf Designs, Inc. in the United States starting in 2000.

* cited by examiner

CONTROLLABLE WATCH WINDER FOR SELF-WINDING WATCHES

BACKGROUND OF THE INVENTION

1. Field of the Invention

This invention relates generally to mechanisms for winding self-winding mechanical watches. In particular, the invention describes an automatic watch-winding apparatus for keeping a self-winding watch wound during periods of non-use.

2. General Background and State of the Art

Self-winding watches have been available for many years and are known for keeping a mechanical wrist watch wound while it is worn by a user. The winding mechanism of a self-winding watch typically comprises a rotary pendulum or rotor that is connected through a gear reduction system to a mainspring adapted to drive the escape mechanism of the watch. The pendulum pivots about a bearing and is generally capable of rotating a full 360 degrees. When the watch is worn, the random movements of the wearer cause the rotor to oscillate back and forth, or to spin completely about its axis, to wind the mainspring. When completely wound, the mainspring will generally have sufficient energy to run the watch for up to about 12 to 48 hours, depending on the particular type of watch. Some watches can store enough energy to run eight days. In any event, the daily use of the watch will normally be sufficient to maintain continuous operation overnight, even if no winding takes place at night. However, it is not uncommon for a person to own more than one watch, for use on different occasions such as sporting events, formal attire, or office attire. Thus it will be appreciated that if one watch in a collection of watches is not worn for a few days, the energy in its mainspring will completely dissipate. Once the spring is unwound, a self-winding watch cannot, as can a manually wound watch, be fully rewound in a few seconds by the user. The task of maintaining multiple watches wound and operating is an inconvenience, and may also include resetting the time on the watch each time the spring runs down. Thus, the owner of a self-winding watch may rely on a watch winder to wind the watch during periods of non-use.

A watch winder is a powered device designed to keep a self-winding watch wound, thereby eliminating the need for manual rewinding and resetting. Prior art watch winders typically include a power driven spindle or turntable adapted to hold and rotate the watch about an axis coincident with its center. During rotation, the pendulum or rotor of the watch will hang downward under gravity, and the watch will rotate about the stationary rotor. In certain prior art winders, an electronic circuit is provided to start and stop the movement of the spindle. Yet, a number of problems are encountered in the prior art. Typically, the control circuit of a prior art watch winder is configured to permit the spindle to rotate for a set period of time. This may be unproblematic for most self-winding watches, but where the watch is large or heavy, the weight of the watch may cause the powered winding mechanism to slow down, resulting in the watch being not completely wound after the spindle ceases turning. Further, some watch winders provide more than one spindle to run off a single DC battery or power source. When more than one spindle is being powered, the speed of rotation of both spindles may be slower than when only one spindle is being powered off the same power source. These factors introduce problems for watch winding mechanisms configured to run for a set period of time. Power fluctuations, as well as battery strength, can also affect the speed of rotation.

A further problem may be encountered with prior art watch winders if, for example, a user places his watch in a winder and starts it running intending to leave the watch in the winder for, say, 36 hours before he wears it. If the watch takes only 12 hours to wind, then 24 hours may be spent winding a fully wound watch. This is an inefficient use of battery energy, and may even be mechanically undesirable for the watch. Alternatively, under the same circumstances, if the user places his watch in a winder knowing it is fully wound, then 36 hours may be spent winding a fully wound watch, to even greater wasteful effect. The prior art has not sufficiently taken into account such questions of battery efficiency. Further, the prior art has not adequately provided for various aspects of convenient use, such as where different watch types have mechanisms with different winding requirements.

Problems can be encountered in that certain self-winding watches may have a plurality of spring mechanisms, or so-called "complications," dedicated to running separate features of the watch. For example, a first spring mechanism may be dedicated to running the hour and minute hands of the watch, while a second spring mechanism may be dedicated to running the calendar and the lunar phase indicator. Where such separate spring mechanisms are included, they may be configured to be wound in opposite directions. Thus, it may be necessary for a watch-winder to rotate, alternately, clockwise and counterclockwise in order to wind both spring mechanisms. However, some self-winding watches are only wound by the rotor rotating in one direction, either clockwise, or anticlockwise, so that alternating the direction of rotation may actually amount to a waste of battery energy in the case of such watches. Furthermore, in the prior art, certain known watch winders rotate only a single revolution in one direction and then pause for a period of approximately a minute before rotating a single revolution in the other direction to be followed by another pause of approximately one minute, and so on, thus repeating the pattern until the unit is deactivated. This pattern of intermittent operation with frequent starts and stops, while adequate to wind many self winding watches, has the disadvantage of resulting in an inefficient use of stored battery power.

Thus, a need exists for an improved watch winder that will address the needs of the prior art. It is believed that the present invention fulfills all of these needs.

INVENTION SUMMARY

Briefly, and in general terms, the present invention provides an improved watch winder. In particular, the present invention provides a method and apparatus for winding a watch in such a manner that will save power, at the same time as providing greater assurance that the watch will be fully wound at the completion of the winding process when the user decides to wear the watch. The invention provides for greater ease of use and adaptability in a watch winder in that the invention caters to various types of self-winding watches with differing winding mechanisms. It also allows the user to more easily insert the watch on the winder.

More specifically, and in a presently preferred embodiment, by way of example, and not necessarily by limitation, the watch winder of the present invention includes a rotatable turntable adapted to rotate a self winding watch, a motor configured to rotate the turntable, and an electronic circuit to control the motor, the circuit being configured to commence rotation of the turntable after first introducing a period of delay after the circuit is activated. Such delay facilitates ease of use by the user, and efficiency of battery energy consumption.

Another feature of the invention includes the capability of the electronic circuit to identify each rotation of the turntable, and to count the total number of rotations. The electronic circuit may be configured to automatically pause rotation of the turntable after a predetermined number of rotations, whereafter rotation may automatically recommence. The circuit may be further configured to predetermine the direction of rotation of the turntable, so that it may reverse directions after each pause, or maintain a constant clockwise direction, or a constant counterclockwise direction.

In another embodiment, the electronic circuit may be manually adjusted, prior to use of the winder, to variably predetermine the number of rotations between pauses, and the length of the pauses. In yet a further embodiment, the number of rotations and the length of the pauses may be preprogrammed in the circuit, without the capability of manual adjustment.

Another aspect of the present invention is directed to a cuff configured to allow a wrist watch to be easily mounted upon it, for insertion into the turntable of the watch winder. The cuff includes an inner core of open cell foam and a covering of porous material, both core and material being chosen for their characteristic of high porosity, allowing the rapid ingress and escape of air when the cuff is compressed, and when compressive force is released. This quality allows the cuff to be rapidly compressed to facilitate mounting and demounting of a wrist watch.

Other features and advantages of the invention will become apparent from the following detailed description, taken in conjunction with the accompanying drawings, which illustrate, by way of example, features of the invention.

DETAILED DESCRIPTION OF THE PREFERRED EMBODIMENTS

With reference to the drawings, which are provided for purposes of exemplary illustration, a new and improved watch winding mechanism and method embodying the principles and concepts of the present invention and generally designated by the reference number 30 will be described.

Figure 1A:
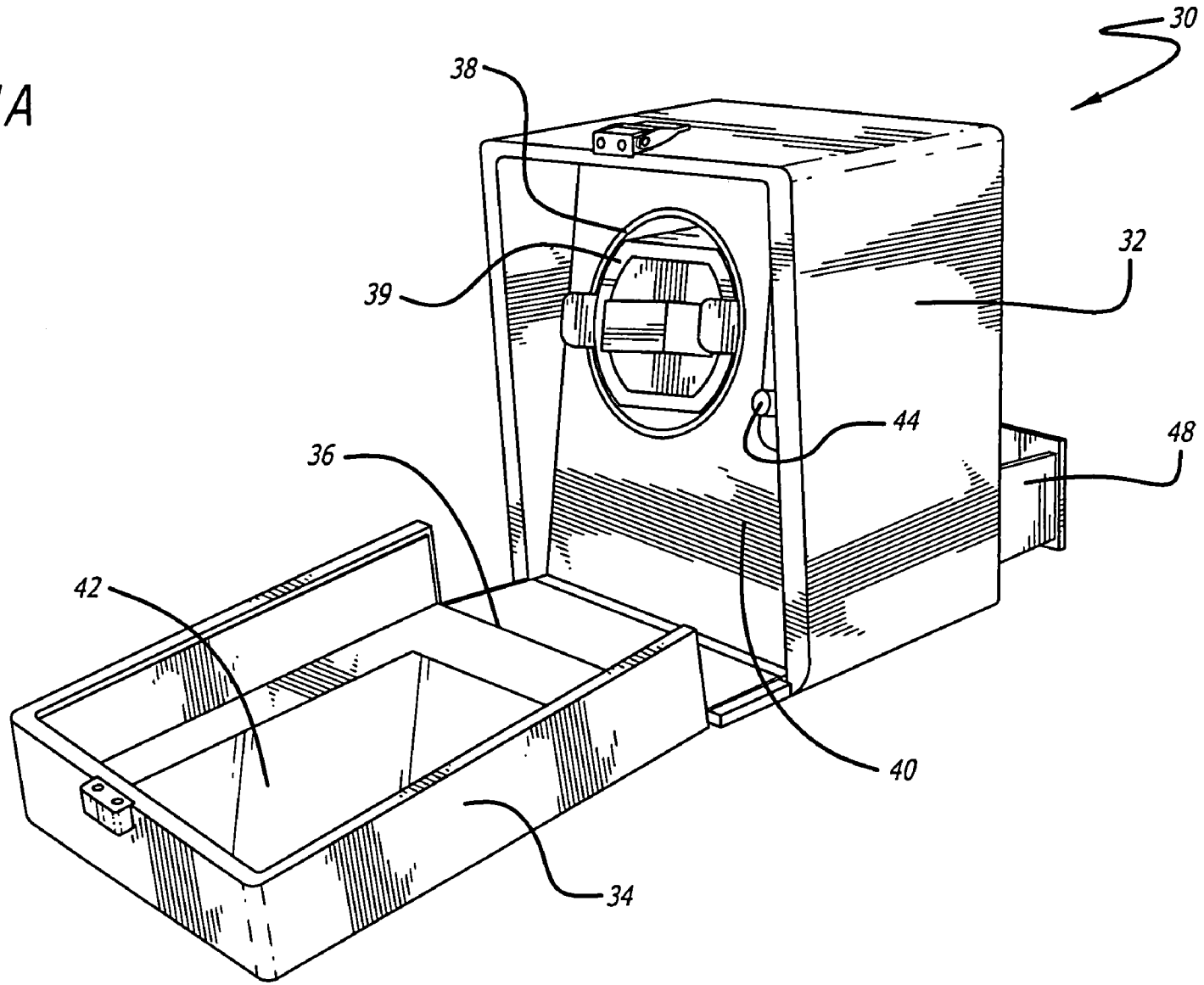
FIG. 1A is a perspective view of a watch winding apparatus according to the present invention, showing specifically the outer housing and features thereof.
Figure 1B:
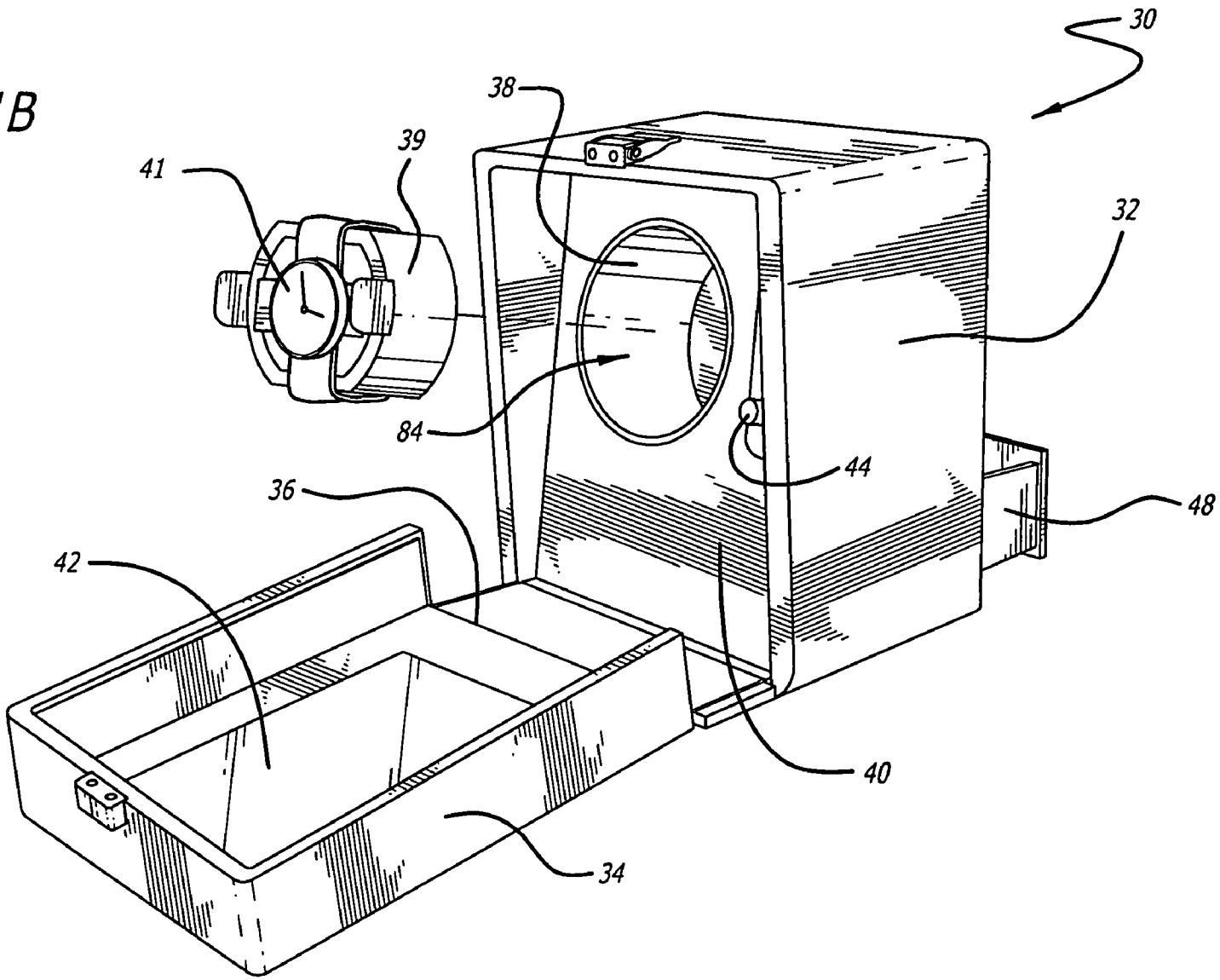
FIG. 1B is a perspective view of the watch winding apparatus shown in FIG. 1A, showing a removable cuff with a watch mounted thereon, separated from the rest of the apparatus.
Figure 3:
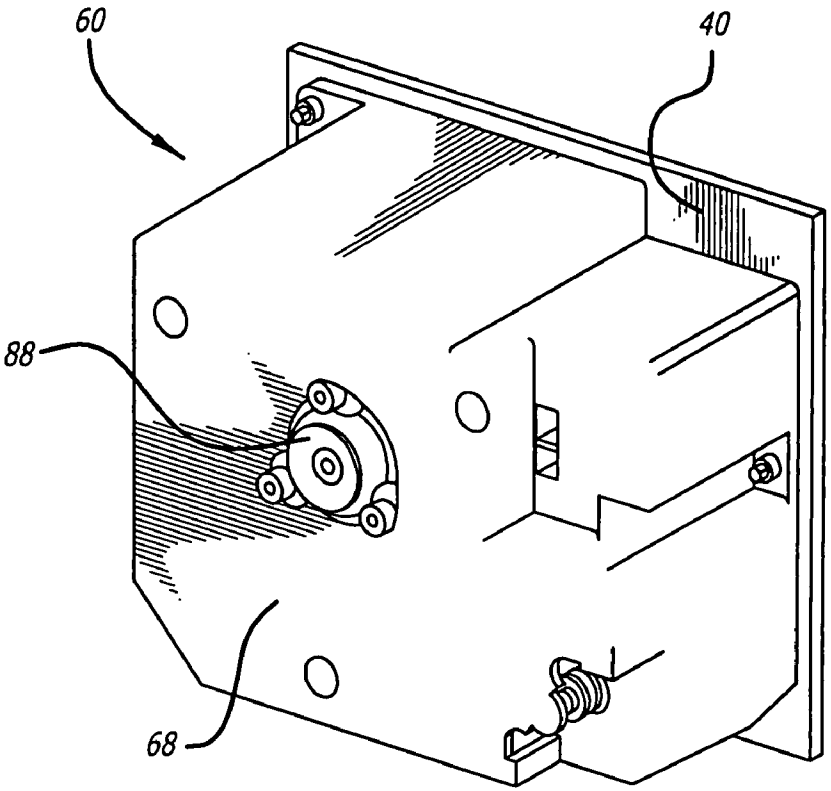
FIG. 3 is a bottom perspective view of the watch winding mechanism shown in FIG. 2.
Figure 2:
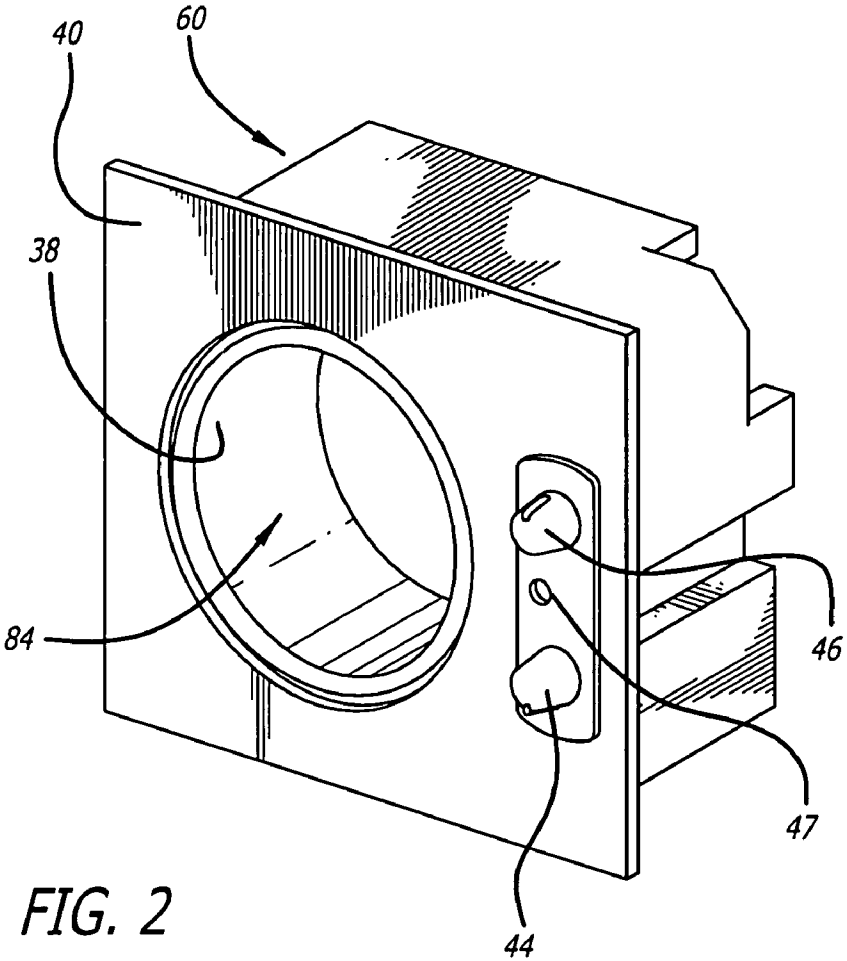
FIG. 2 is a top perspective view of a watch winding mechanism enclosed within the housing shown in FIG. 1, embodying novel features of the present invention.

In a preferred embodiment as shown in FIGS. 1A and 1B, a watch winder 30 has a rectangular sided exterior housing 32 including an exterior front cover 34 that opens downwardly about a bottom hinge 36 to expose a turntable 38 mounted centrally on an interior front wall 40. A cylindrical cuff 39 is provided, configured to be removable from the turntable to permit a watch 41 to be mounted on the cuff, so that the cuff and watch combination may be installed on the turntable 38. The front cover 34 may include a glass or plastic transparent window 42 for viewing the contents of the housing. Also mounted on the interior front wall 40 are control switches 44, 46 (46 not visible in FIGS. 1A and 1B) for controlling the operation of the turntable 38. An LED, or light emitting diode 47 (FIG. 2) may also be installed on the control panel to indicate the status of the winder. For example, a green light may indicate that the winder is activated, and a red light may indicate a low battery condition. A lockable drawer 48, adapted to hold DC batteries, slides out of the rear wall of the exterior housing 32. A fixed length ribbon (not shown), attached to a fixed point inside the interior of the housing at one end and to the drawer at the other end, prevents the drawer from being removed from the housing in the event it is pulled out without restraint. A DC jack (not shown) is also mounted on the rear exterior wall of the housing to receive an input plug from an optional AC/DC converter, connected to a 110 or 220 volt AC source (not shown).

The watch winding apparatus 30 of the present invention includes, positioned within the exterior housing 32, an interior housing 60, as exemplified in FIGS. 2-6. The interior housing 60 is configured to contain the rotatable turntable 38 with its cuff 39 (not shown in FIGS. 2-6) for holding a watch on the turntable, a drive assembly 64 (FIG. 4) for rotating the turntable, an electronic circuit 66 (FIG. 4) for controlling the drive assembly, and the control switches 44, 46 for controlling the turntable via the circuit 66.

In a preferred embodiment, the interior housing 60 may be formed of moldable plastic to comprise a back wall 68 to which there are attached two vertical side walls 70, 72, a top wall 74, and a bottom wall 76 to define an interior space 78. When the interior housing 60 is positioned within the exterior housing 32, the interior space 78 of the interior housing is sealed by the interior front wall 40 of the external housing 32.

Figure 5:
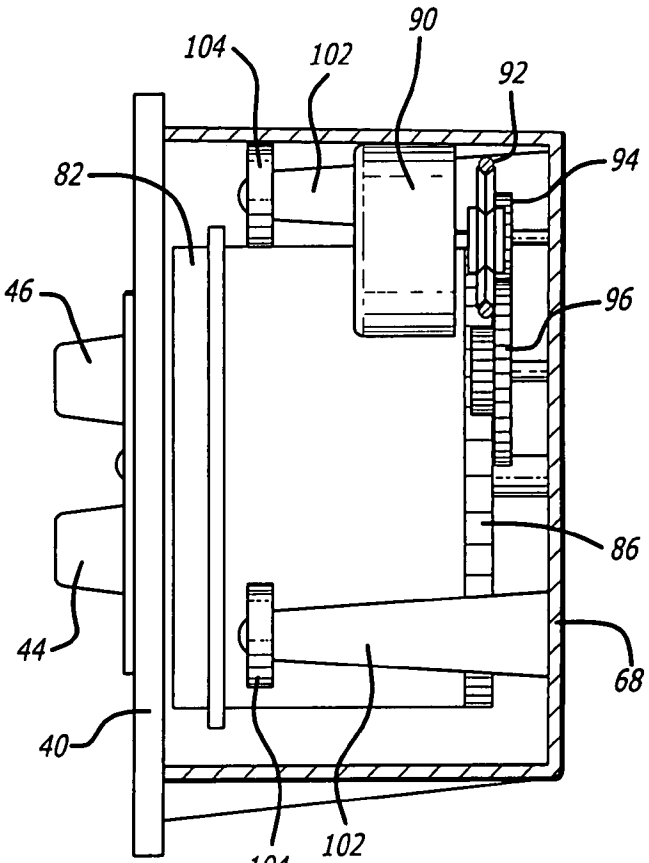
FIG. 5 is a sectional side view of the watch winding mechanism shown in FIG. 4, taken substantially along the line 5-5 in FIG. 4.
Figure 4:
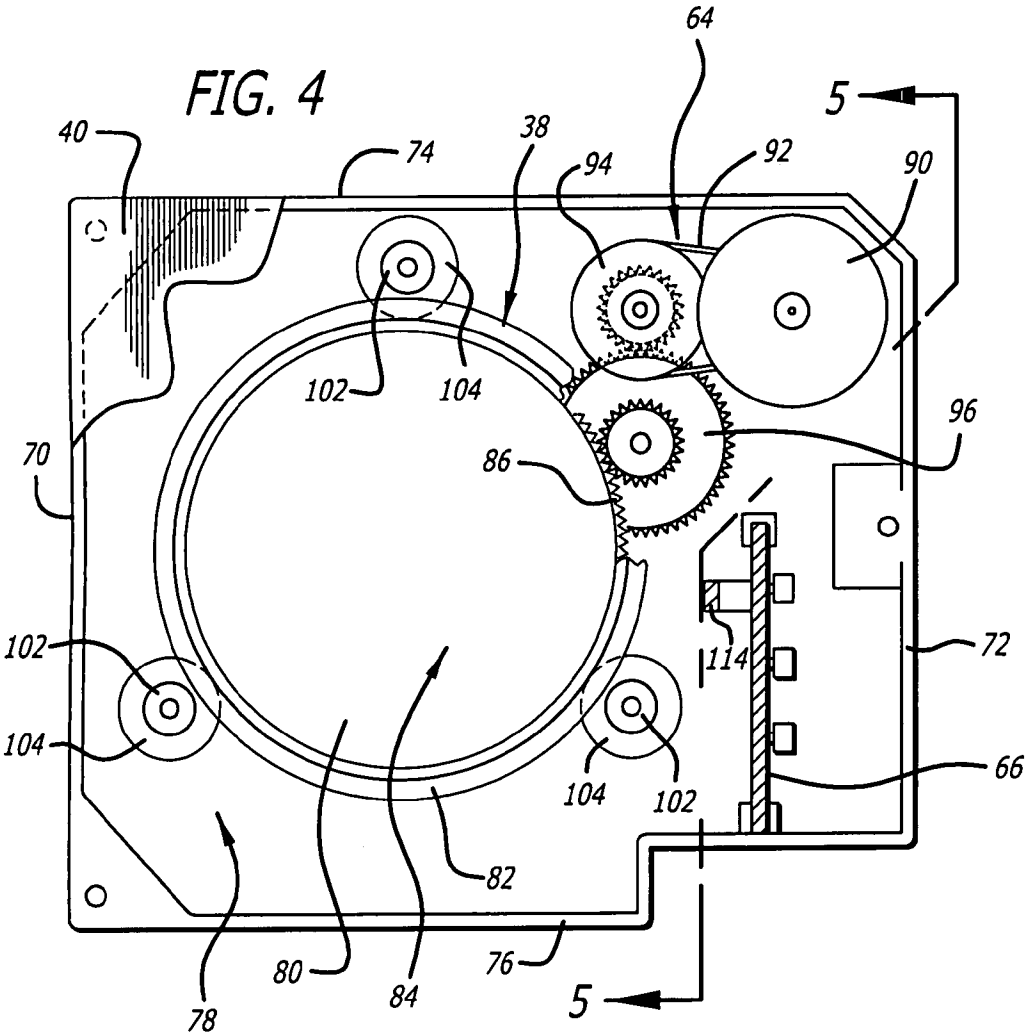
FIG. 4 is a fragmentary top view of the watch winding mechanism of FIG. 2, with top cover removed.
Figure 6:
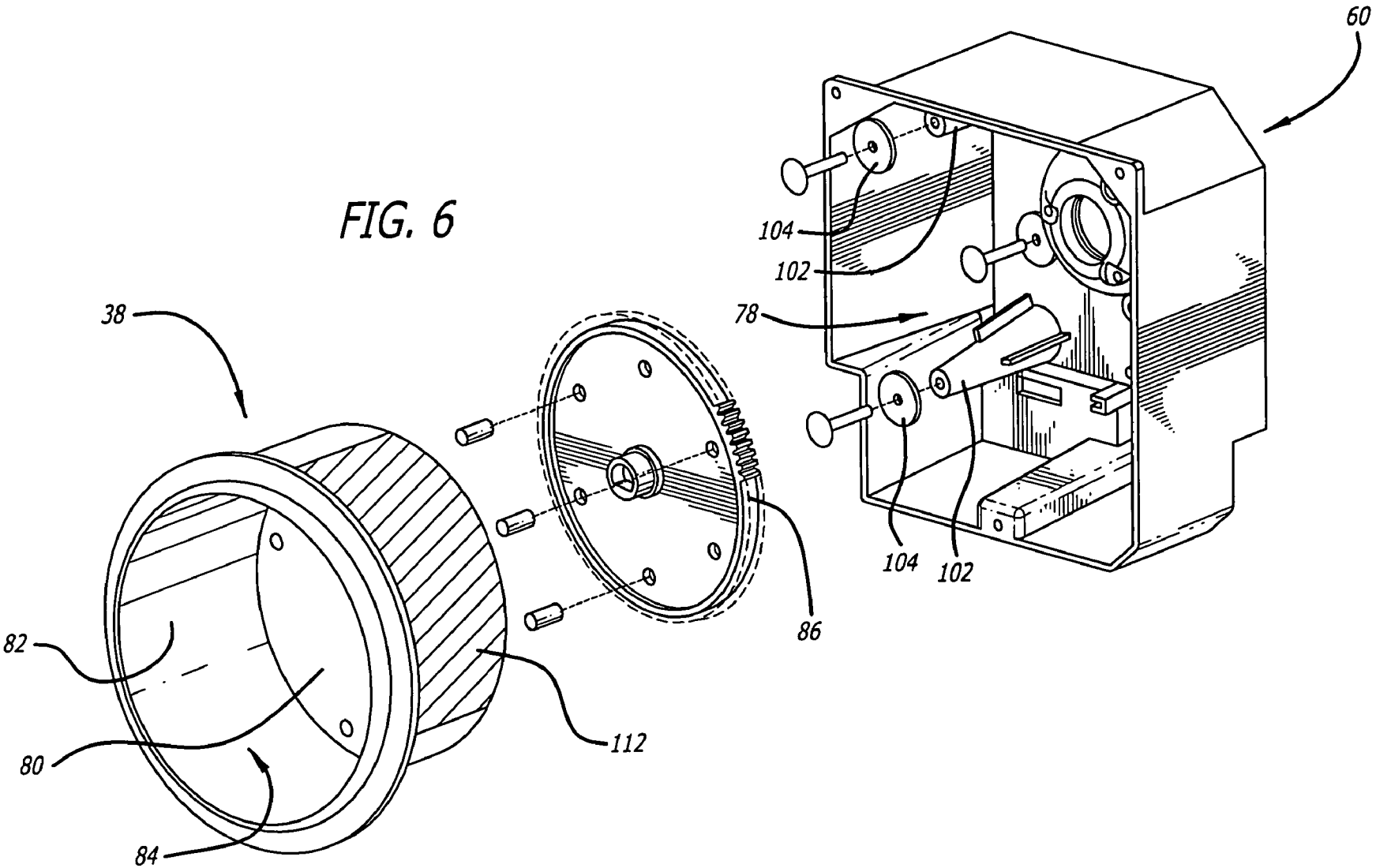
FIG. 6 is a partially exploded view of certain aspects of the watch winding mechanism shown in FIGS. 2-5.
Figure 8:
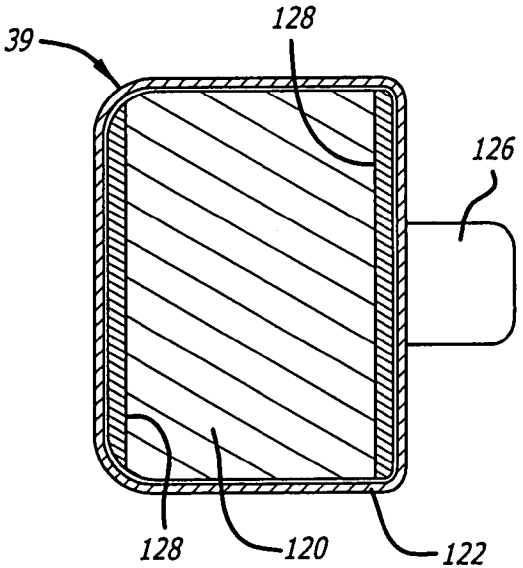
FIG. 8 is a sectional view, taken substantially through the line 8-8 of FIG. 7.
Figure 7:
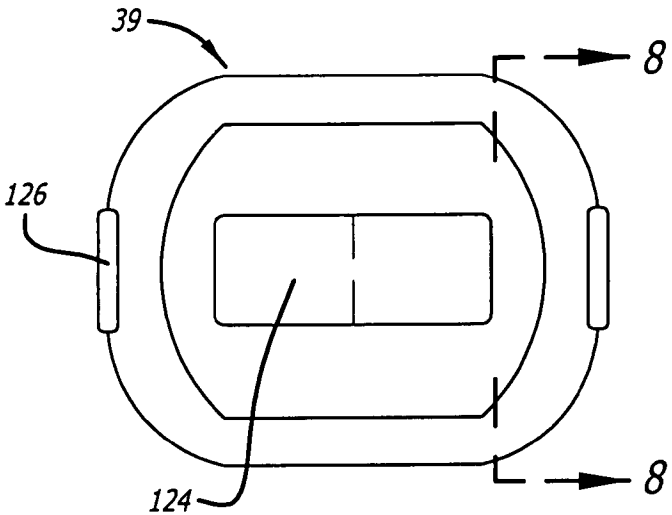
FIG. 7 is a front elevational view of a cuff suitable for holding a watch and for insertion into the watch winding apparatus of FIGS. 1A and 1B.
Figure 10:
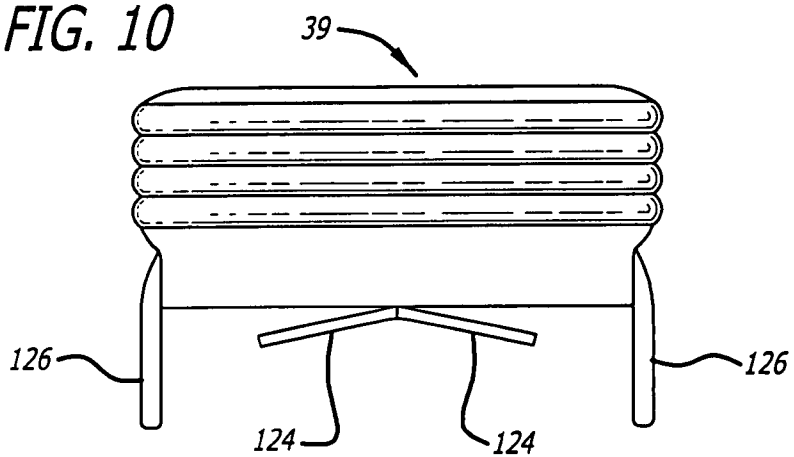
FIG. 10 is a side elevational view of the cuff of FIG. 7, showing the cuff compressed from front to back, along its axis, to facilitate mounting a wrist watch thereon.
Figure 9:
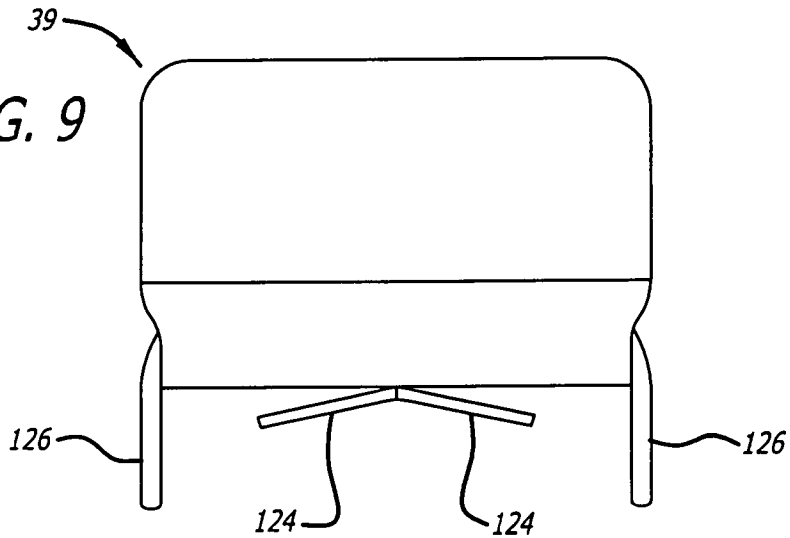
FIG. 9 is a side elevational view of the cuff of FIG. 7.

Referring to FIGS. 4-6, the turntable 38 includes a circular base 80 and a cylindrical sidewall 82, giving it a drum-like shape with an interior bore 84 open at one end. A toothed large gear wheel 86 having a diameter approximately the same as the base 80 is attached directly to the base. The turntable 38 is rotatably attached to the interior housing 60 through the large gear wheel 86 which is connected to a bearing 88 (FIG. 3) mounted on the back wall 68 of the interior housing.

The drive assembly 64 comprises a small electric motor 90 which transmits rotational movement to the turntable 38 via a pulley 92 and intermediate gears 94, 96 configured to mesh with the large gear 86 on the turntable. The use of multiple gears allows for more accurate control of the rotation speed of the turntable than with a single gear. Power for the motor is supplied either by closed cell battery, or by a power cord. Where a power cord is used, with an AC/DC adapter, it plugs into a conventional 110 volt or 220 volt AC outlet. It is preferable to use a motor selected for low power use, while still having the capability to keep proper motion for a watch up to 350 grams, which is about the heaviest watch currently obtainable.

In a further aspect of the invention, best exemplified in FIGS. 4-6, the interior housing 60 may include a plurality of cantilever supports 102 extending from the back wall 68 into the interior space 78, arranged in relation to each other in a generally triangular pattern. Each support 102 includes a rotatable annular bearing 104 at a terminal end portion of the support, preferably made of rubber or a similar resilient compound. Each support 102 is positioned to permit each bearing 104 to abut the outer surface of the cylindrical wall 82 of the turntable 38 and provide a diametrically inward force to stabilize the turntable against lateral movement, particularly when the turntable is being powered by the motor. Each annular bearing 104 is preferably positioned to protrude laterally beyond the axial shadow of its associated cantilever support 102, to prevent any interference between turntable 38 and cantilever support 102, allowing the turntable to butt only against the bearings 104. This particular configuration of cantilever supports with resilient bearings provides for smooth, quiet rotation of the turntable.

When the watch winder 30 is in use, a self-winding watch 41 is mounted on a cylindrically shaped cuff 39 (FIG. 1B) which is then inserted into the bore 84 of the turntable 38 so as to allow the face of the watch to protrude on the outside of the front wall 40 of the housing 32, and to allow the watch to be rotated by the turntable in the plane of the hands of the watch. Control of the turntable's rotation is achieved by the electronic circuit 66 (FIG. 4), which may include a conventional programmable microprocessor capable of receiving input signals, and of generating output signals to achieve control of the turntable. As described in further detail herein, the microprocessor may be configured to activate the motor 90, to determine in which direction the motor will rotate, to count and to limit the number of rotations executed by the turntable 38, to interrupt rotation of the turntable for interspersed periods of time, and/or to terminate rotation of the turntable entirely after a number of rotations until the circuit 66 is manually reactivated. Operation of the control circuit 66 through the microprocessor is achieved using, for example, switches 44, 46 located on the front wall 40 of the housing 32.

In further detail, control circuit 66 is configured to count the number of revolutions turned by the turntable 38. A light-reflective film 112, formed, for example, as a silver or copper coated plastic film, may be fixed to the outer surface of the turntable's cylindrical wall 82 such that less than 360 degrees, preferably 180 degrees, of the wall circumference is covered by the film 112 (FIG. 6). Included in the circuit 66, an infrared reflective sensor 114 is positioned proximate the cylindrical wall 82 such that, when the turntable rotates through 360 degrees, light emitted from the infrared sensor is reflected from the film 112 only throughout the rotational angle wherein the film is present on the outer wall 82, but not where the film is absent. The resulting break in reflected light each revolution is detected by the infrared sensor and is interpreted by the circuit 66 as marking the passage of a single revolution. Additionally, the circuit 66 is configured to have a memory which maintains a cumulative count of the number of rotations executed by the turntable. As indicated previously, setting the motor to run for a set period of time may not be sufficient to fully wind the watch, especially where the watch is a large or heavy watch that may cause the speed of rotation to be slowed or where there is a fluctuation in the power supply. Rather, setting the circuit 66 to allow rotation of the turntable for a set number of rotations before stopping, as contemplated by the present invention, will tend to overcome this problem and have the advantage of terminating the rotations when the watch is likely to be fully wound, thereby avoiding unnecessary waste of battery energy. A suitable infrared reflective sensor for detecting the completion of a rotation by the turntable is a subminiature photointerrupter made and supplied by Sharp, having model number GP2S40.

In a further aspect of the invention, the circuit 66 may be configured to automatically delay the start of the turntable's rotation, so that, when the circuit is initially activated through the switches 44, 46 rotation of the turntable commences only after a period of time. In one preferred embodiment, the delay is between 8 and 16 hours, preferably about 12 hours. The delay in commencing winding avoids the wasteful effect on the batteries of winding a watch that is already fully wound when placed on the winder after a day's use, and then going on to spend hours further winding it. The delay allows the watch to run down to some extent before the winding commences. In another aspect of the invention, the circuit 66 may be configured to provide a short delay in starting rotation, of as little as ten seconds, preferably between 5 and 15 seconds. This has the advantage of allowing the user to activate the circuit through the switches 44, 46 before he places his watch on the turntable, and gives him sufficient time to install the watch on the turntable after he has switched on the circuit. Both modes of start-delay operation (i.e., long delay and short delay) can be provided in a single watch winder, with the user having the ability to choose between the two modes by selecting the corresponding position on a three position (off-mode 1-mode 2) switch 44. In an alternative embodiment, the circuit 66 may be configured to allow the user to manually alter the delay time available for each of the various modes of operation.

Preferably, the low battery warning indicator will be functioning even when the switch 44 is in the "off" position. When the switch 44 is in the "mode 1" position (short delay) or "mode 2" position (long delay), both the power indicator (green) and the warning indicator (red) will be operational. In a preferred embodiment, the warning indicator also will be flashing when a locked condition of the turntable is detected.

Based on the capability of the circuit to count the number of rotations executed by the turntable, the circuit 66 may be further configured to pause the motor once a pre-programmed number of rotations has been achieved, and to resume rotation after the pause, continuing with this pattern of rotation and pause until the winder is manually turned off. However, in a further aspect, the circuit 66 may be configured to automatically terminate the cycles of rotation and pause for a period of time after a predetermined total number of rotations has been executed, preferably, in one embodiment, between 600 and 1200 rotations. The number of rotations will be set to correspond to the average number needed to fully wind most self winding watches. While the number can vary depending upon watch brand, numbers of complications, and the like, in practice, it has been found that about 900 rotations is optimal for most watches In a preferred embodiment, the circuit may be configured to automatically cause the turntable to be rotated between 100 to 200 rotations, preferably about 150 rotations in a twenty minute period, before pausing for between 30 and 90 minutes, preferably 70 minutes, and then to repeat this cycle several times, preferably six times, before automatically turning off for an extended delay period (preferably about 15 hours). This combination is believed to be optimal in preservation of battery energy. A minimum of at least five rotations per cycle is needed for winding watches with certain unique complication. In a further embodiment, the range of rotations is between 50 and 2500 rotations in each cycle, to accommodate watches with unusual winding systems.

In a further embodiment, the circuit 66 may be configured to allow the user to manually adjust the circuit, prior to use of the winder, to variably alter and predetermine the number of rotations in each set of rotations and the length of the pause period between sets of rotations. In yet another feature, the circuit 66 may be configured to allow the user, prior to use, to cause the direction of each succeeding set of rotations to automatically either reverse direction, or to be all clockwise, or to be all counter-clockwise, to suit the needs of the particular watch as previously described, controlled by switch 46 which may have a three position setting—clockwise, alternating directions, anti-clockwise.

For example, in one preferred embodiment, the switch 46 may be set by the user to select between three possible modes of operation. In a first mode of operation, the turntable will rotate clockwise for 150 revolutions, and then stop, representing one rotation cycle. The total time taken for this one rotation cycle will be about 1.5 hours, with about 20 minutes of rotation time and about 70 minutes of pause time. This rotation cycle then repeats six times, and then stops for a long stop period, preferably about 15 hours. The total time taken from the start of rotation to the end of the long stop period is about 24 hours. It has been found that the periods 20 minutes for rotation and 70 minutes for pause enables the winder to wind most watches, while using minimal power. Further, the number of 150 rotations allows the winder to cover the motion requirements for most watches, while using a minimum of battery power.

In a second mode of operation, the operation is similar to that of the first mode, except that the rotation is in the counterclockwise direction.

In a third mode of operation, the turntable will start rotating in a clockwise direction for 150 revolutions, then rotate for another 150 revolutions counterclockwise, then stop, representing one rotation cycle. The time taken for this one cycle is about 1.5 hours, with 40 minutes of rotation time (20 minutes clockwise and 20 minutes counterclockwise) and 50 minutes of pause time. This rotation cycle then repeats six times, and then stops for a long stop period of about 15 hours, for a total elapsed time from start of rotation to the end of the long stop period of about 24 hours.

Any of these three modes of operation can be used in combination with one of the two start-delay modes of operation described above. If either the short delay or long delay is selected, the delay will be disabled after the first 24 hour cycle is completed.

In another alternative embodiment, the speed of rotation of the turntable and the duration of the pause time, or both, are automatically adjusted and controlled in response to turntable speed to allow for precise time cycle durations, especially where the power source is fluctuating or where a heavy watch is being used.

With reference to FIGS. 7-10, the cuff 39 of the watch winder typically has a generally cylindrical form sized to be inserted into the bore 84 of the turntable. Edges of the cuff may be shaved off to permit a watch to be mounted thereon and still to allow the cuff to be inserted into the cylindrical bore 84. In yet a further aspect of the present invention, the cuff 39 may be configured to be rapidly compressible and decompressible in an axial direction. This feature may facilitate attachment of the watch to the cuff in that the watch strap may be clasped or buckled closed first, whereafter the compressed cuff may be inserted through the closed strap of the watch. After insertion, the cuff is allowed to rapidly decompress under its own elastic qualities to securely hold the watch ready for insertion into the bore of the turntable. In order to achieve rapid compressibility and decompressibility in the axial direction, the cuff 39 of the present invention may be formed of an internal cylindrical block of open cell foam 120 having the overall desired shape of the cuff. The foam block 120 may be sandwiched between two rigid plates 128, made preferably from rigid hardboard, the resulting combination being enclosed in a porous material cover 122 which is stitched or glued closed at the seams. The combination of open cell foam and porous material gives the cuff the desirable characteristic of being rapidly compressible and decompressible, because both the foam and the fabric will allow air to rapidly escape when the cuff is compressed by hand, and to enter the cuff allowing it to rapidly return to its original shape when the compressing force is removed. Additional features of the cuff may include flexible pull tabs 124, made of leather or similar material, set in the center of the circular face 125 of the cuff, to allow the user to take hold of and remove the cuff when its edges are inaccessibly located within the bore of the turntable. Rigid push tabs 126 may be set on the circumferential edges of the cuff, to permit the user to take hold of the cuff and introduce it into the bore of the turntable when a watch is located on the cuff, making the pull tabs 124 inaccessible.

Several modifications in the design of the watch winder also are contemplated. In one modification, the operation of the watch winder can be made controllable via a hand-held infrared remote control device, in lieu of or in addition to the switches 44, 46. In another modification, an LCD readout with a built in clock can be provided to allow the user to visibly observe and set the start time and end time, rotation direction and duration. Voice activated control of the functions is yet another modification, as is audible notification of functions to the user.

Figure 11:
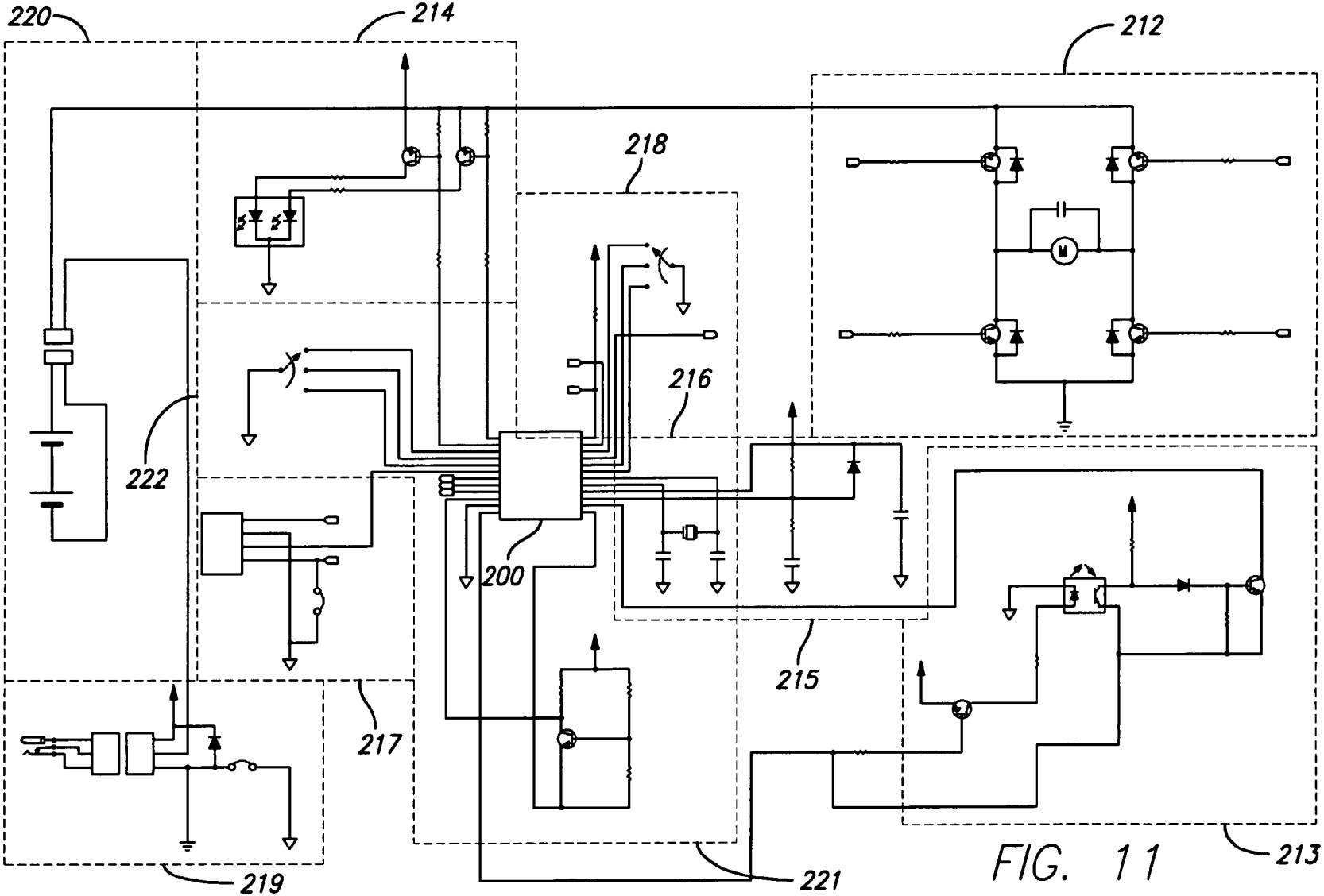
FIG. 11 is a schematic circuit diagram of the electronic circuit that controls operation of the motor of the watch winder of the present invention.

With reference to FIGS. 11-23, the electronic circuit 66 is described in more detail. FIG. 11 depicts the overall circuit, broken into sub-circuits showing their interrelation to each other. The microprocessor, bearing reference numeral 200 is shown at the center of the circuit 66. Sub-circuits 212 through 221 are shown in larger scale in FIGS. 12 through 21 respectively. A suitable microprocessor is the Holtek model HT46R22, 8 bit programmable microcontroller, which is designed for A/D applications, low power consumption, and has timer/event counter capabilities.

Figure 12:
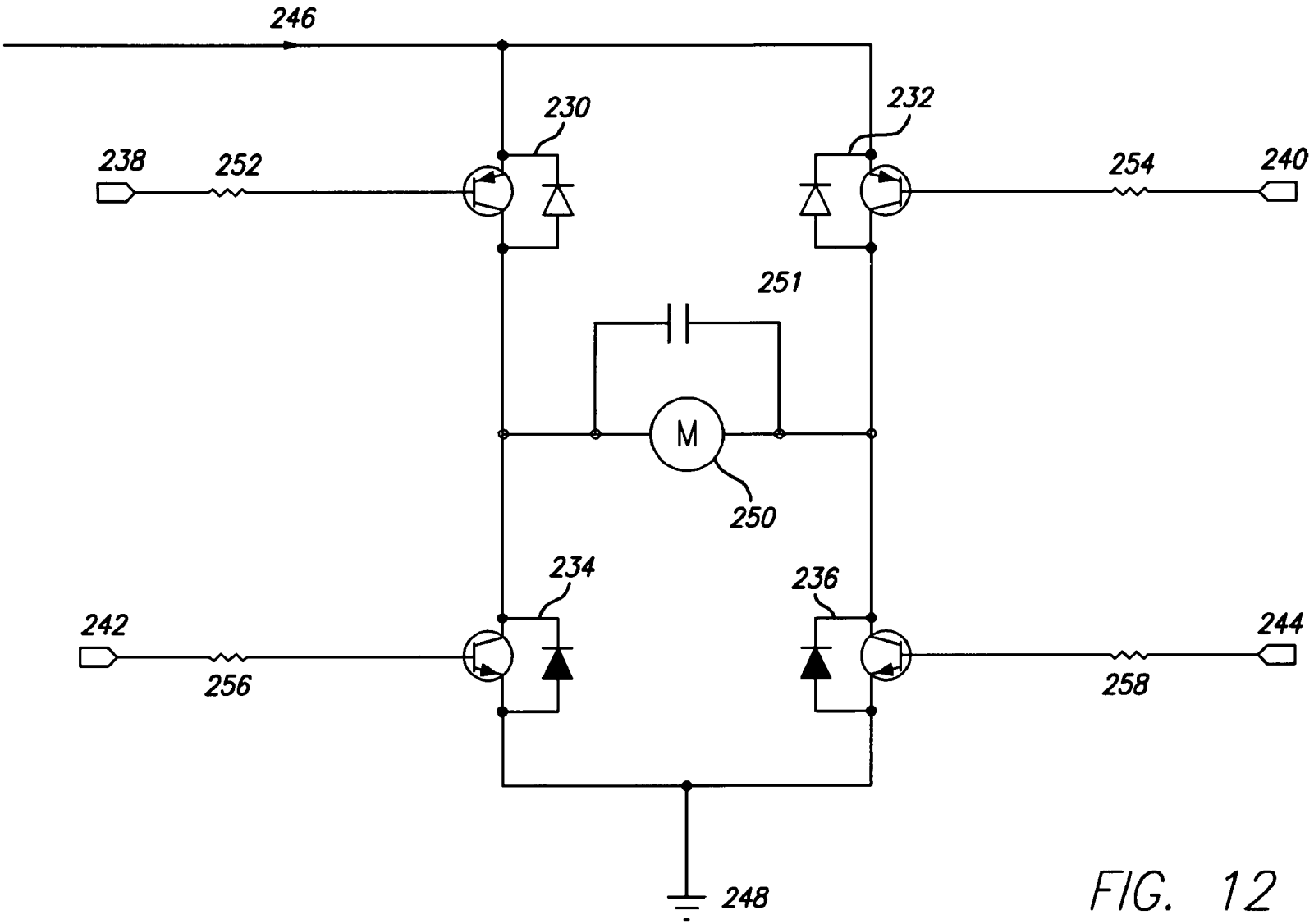
FIG. 12 is a fragmentary portion of the circuit diagram in FIG. 11 showing a portion of the circuit that controls the direction of rotation of the motor.

Sub-circuit 212, shown in FIG. 12 is the motor control circuit comprising four transistors, 230, 232, 234 and 236. The direction of the motor is controlled by the microprocessor which sends signals via four direction connectors 238, 240, 242, 244, so that, for example, when diametrically opposite transistors 230 and 236 are off, and transistors 232 and 234 are on, current flows from line 246 to ground 248 through motor 250 (numeral 90 in mechanical Figures) from right to left, as illustrated in the drawing, causing the motor to turn in a first direction. It will be appreciated that changing the direction of current flow through the motor by turning transistors 230 and 236 on and transistors 232 and 234 off changes the direction of rotation of the motor.

Figure 13:
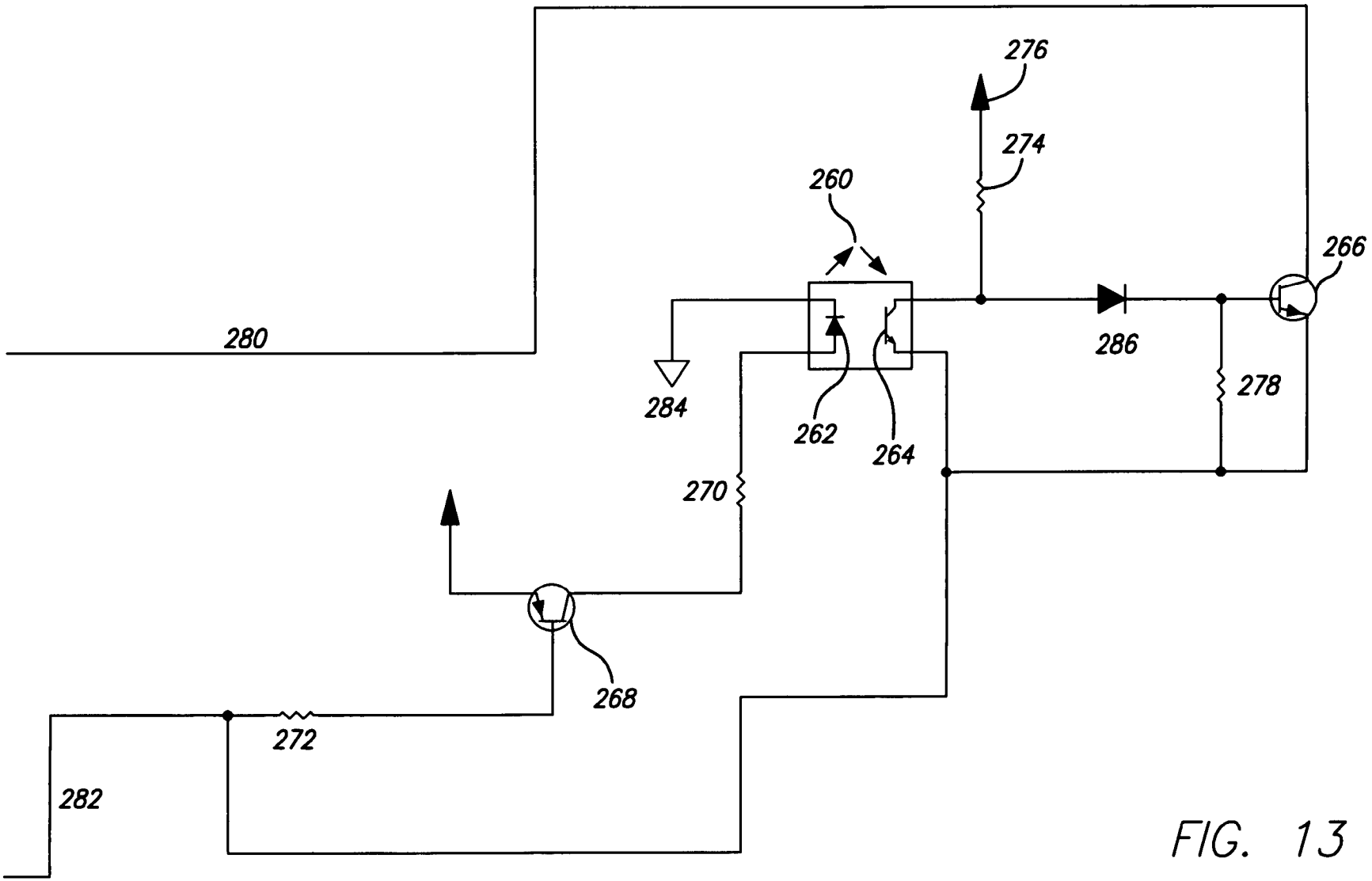
FIG. 13 is a fragmentary portion of the circuit diagram in FIG. 11 showing a portion of the circuit that detects rotation by the turntable.

With reference to FIG. 13, sub-circuit 213 shows the operation of the infrared photointerrupter 260 comprising, a phototransmitter 262 and a photoreceiver 264. As previously set forth, rotation of the turntable 38 past the photointerrupter causes light reflective film 112 to pass by proximate the photointerrupter. Light emitted from transmitter 262 is reflected from the film 112 and perceived by receiver 264 as an energy signal, but when the film is interrupted receiver 264 registers the break in energy signal and communicates this break to processor 200 via line 280 by switching off transistor 266. When the film 112 returns later in the cycle of the turntable, transistor 266 is switched on again until later interrupted. Each interruption is registered and counted by the program memory in the processor 200 for use in controlling the rotation of the motor, as set forth above, through the microprocessor 200 and sub-circuit 212. A signal from the microprocessor on line 282 selectively activates transistor 268 to control operation of the phototransmitter 262.

Figure 14:
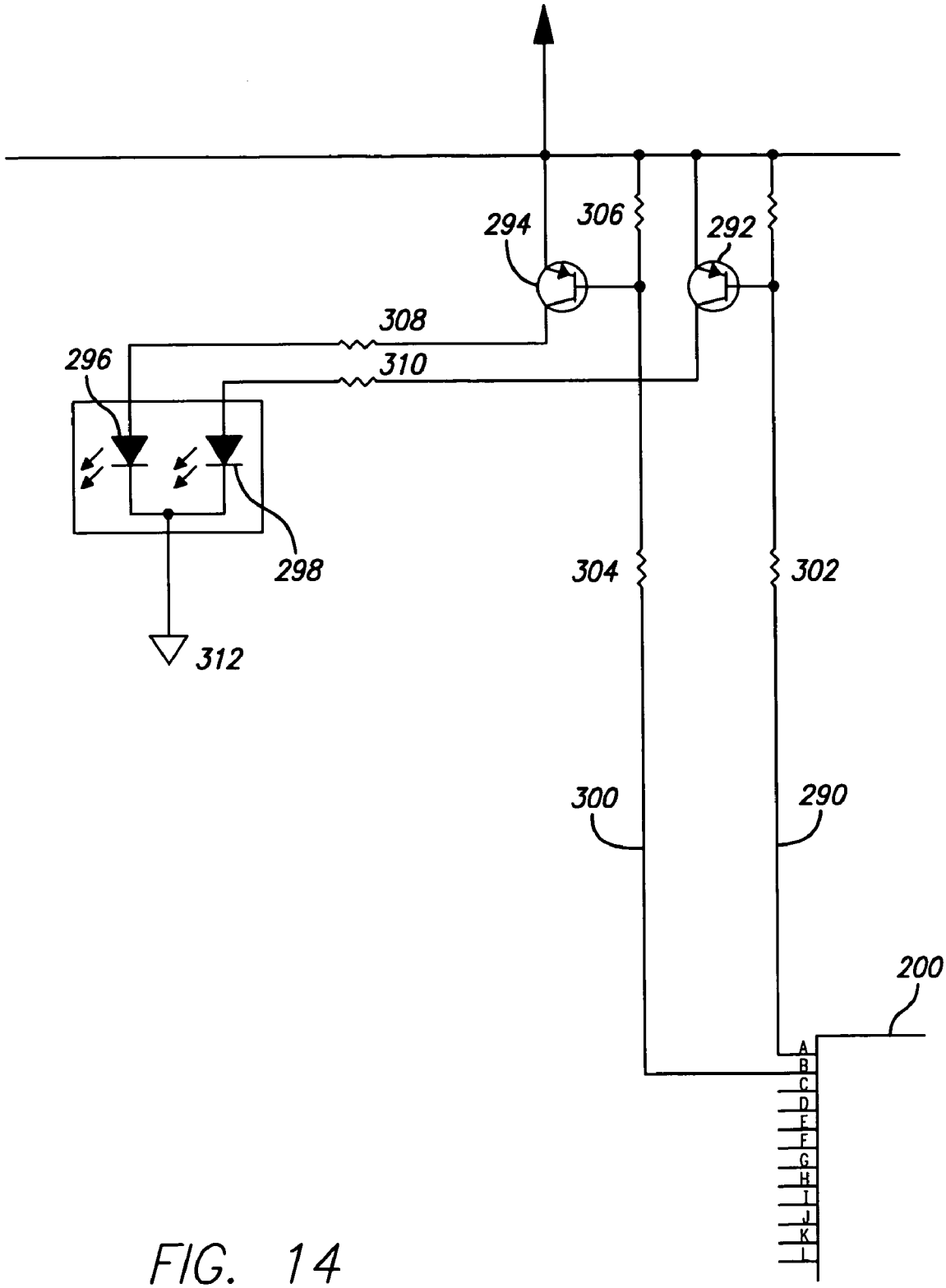
FIG. 14 is a fragmentary portion of the circuit diagram in FIG. 11 showing a portion of the circuit that controls operation of the status LED.

With reference to FIG. 14, sub-circuit 214 shows the operation of the status LED 47, which is configured to show green for the "power" mode, and red for "low battery." When in the "power" mode, the processor 200 sends a signal along line 290 to switch on the transistor 292, allowing current to flow through green LED 298 to ground 312. Additionally, when the battery is below a threshold voltage, the processor sends a signal along line 300 to switch on transistor 294 allowing current to flow to ground through red LED 296. Under this scheme, both green and red may display concurrently.

Figure 15:
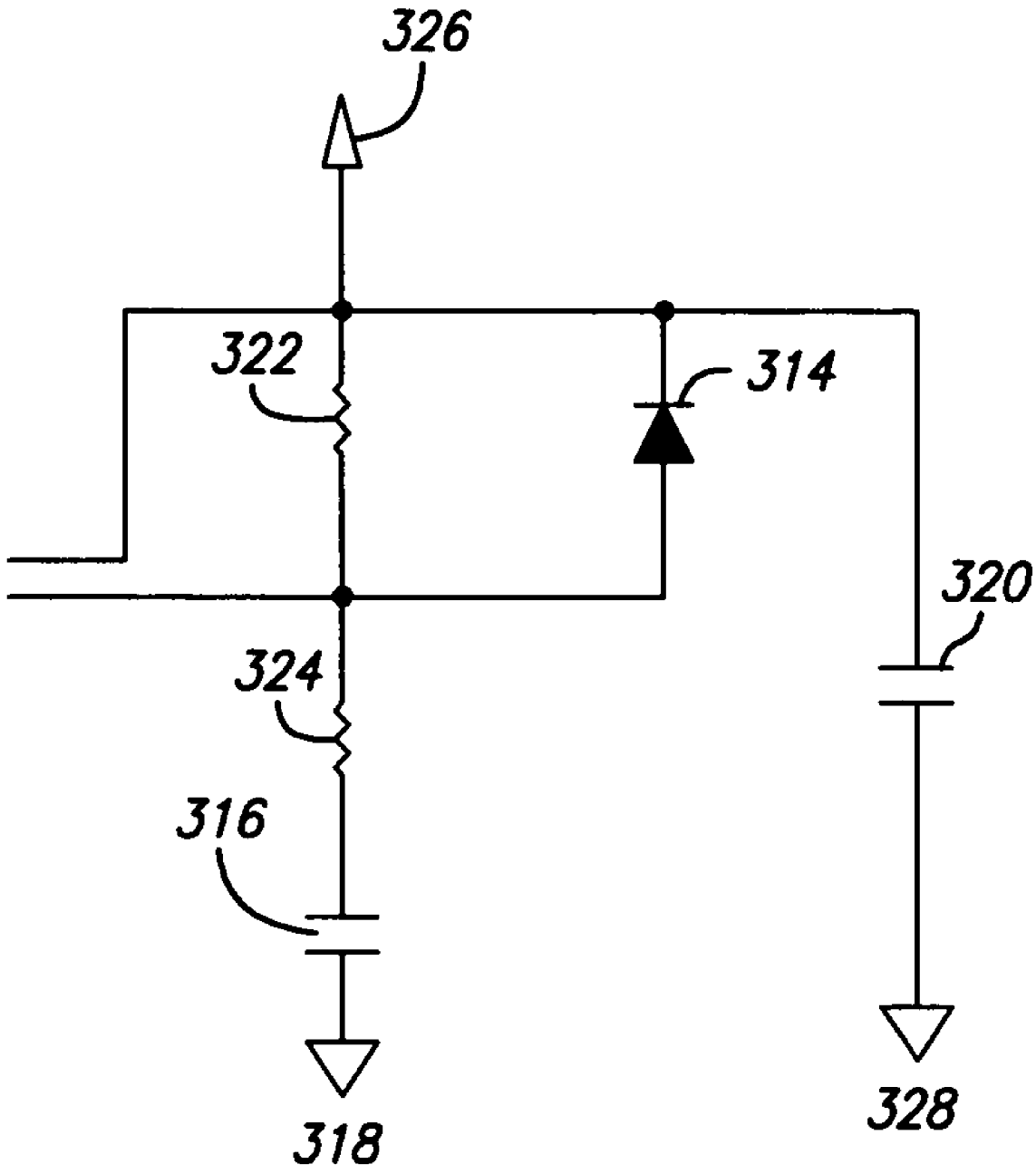
FIG. 15 is a fragmentary portion of the circuit diagram in FIG. 1 showing a portion of the circuit that powers the circuit.

With reference to FIG. 15, sub-circuit 215 shows the power supply which supplies power to the microprocessor 200.

Figure 16:
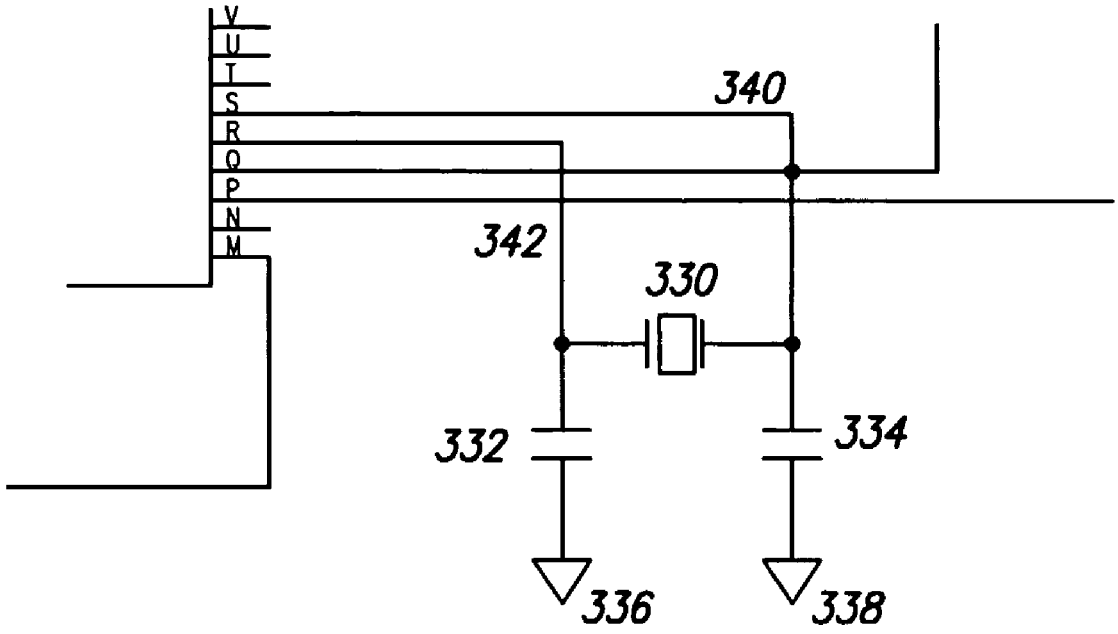
FIG. 16 is a fragmentary portion of the circuit diagram in FIG. 11 showing a portion of the circuit that controls the timer of the microprocessor.

With reference to FIG. 16, sub-circuit 216 shows the oscillator circuit for the system clock in the microprocessor 200. The circuit includes a piezoelectric quartz crystal 330 which preferably has a 32768 Hz frequency, enabling the processor 200 to measure time increments within 0.5 and 1.0 seconds accuracy per day. The crystal insures that the microprocessor 200 accurately counts the elapsed time in minutes, hours and days, to insure that the day cycles of rotation occur reasonably close to an actual 24 hour period.

Figure 17:
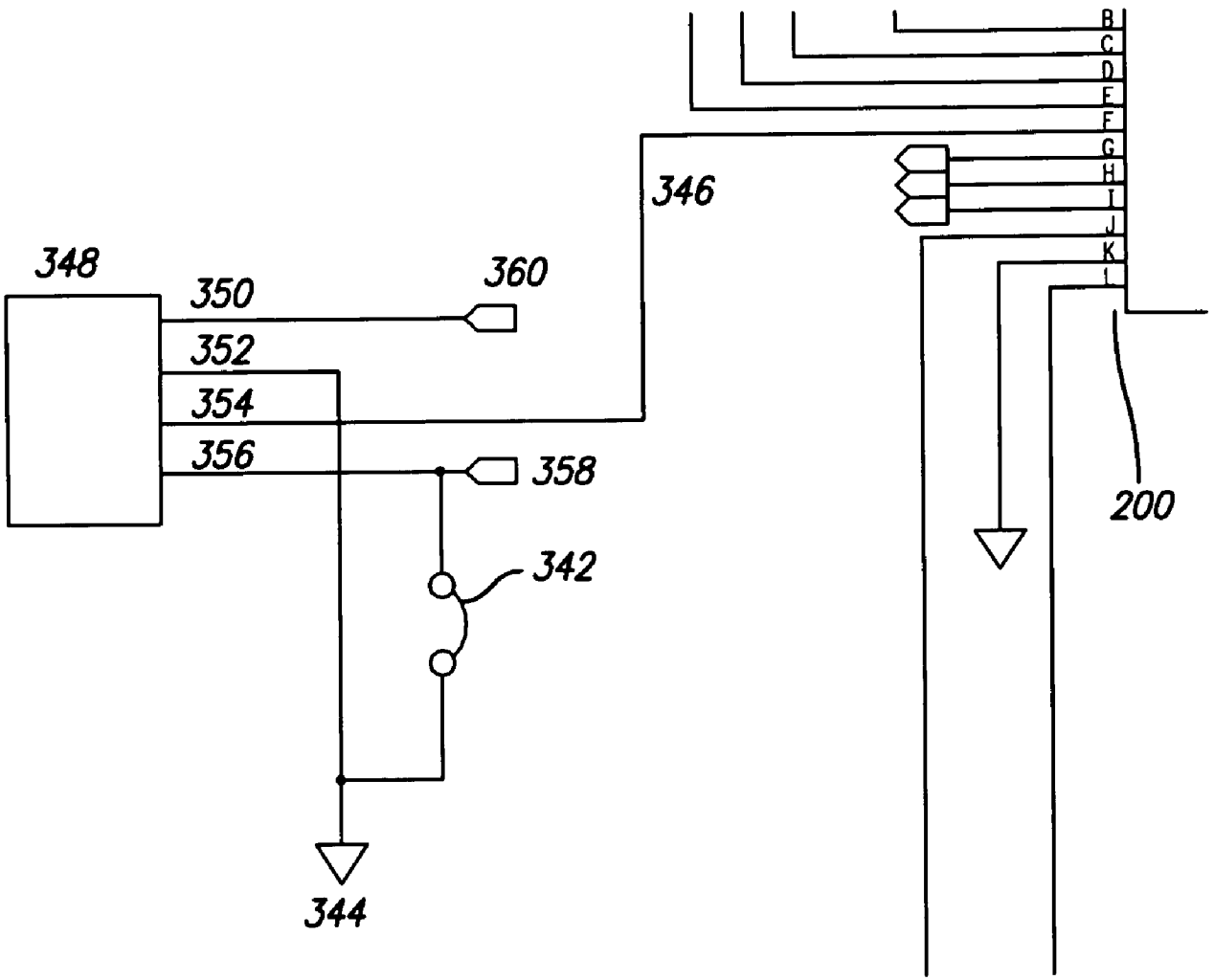
FIG. 17 is a fragmentary portion of the circuit diagram in FIG. 1 showing a portion of the circuit that debugs the circuit.

With reference to FIG. 17, sub-circuit 217 shows the debugging circuit for testing each module prior to installation.

Figure 18:
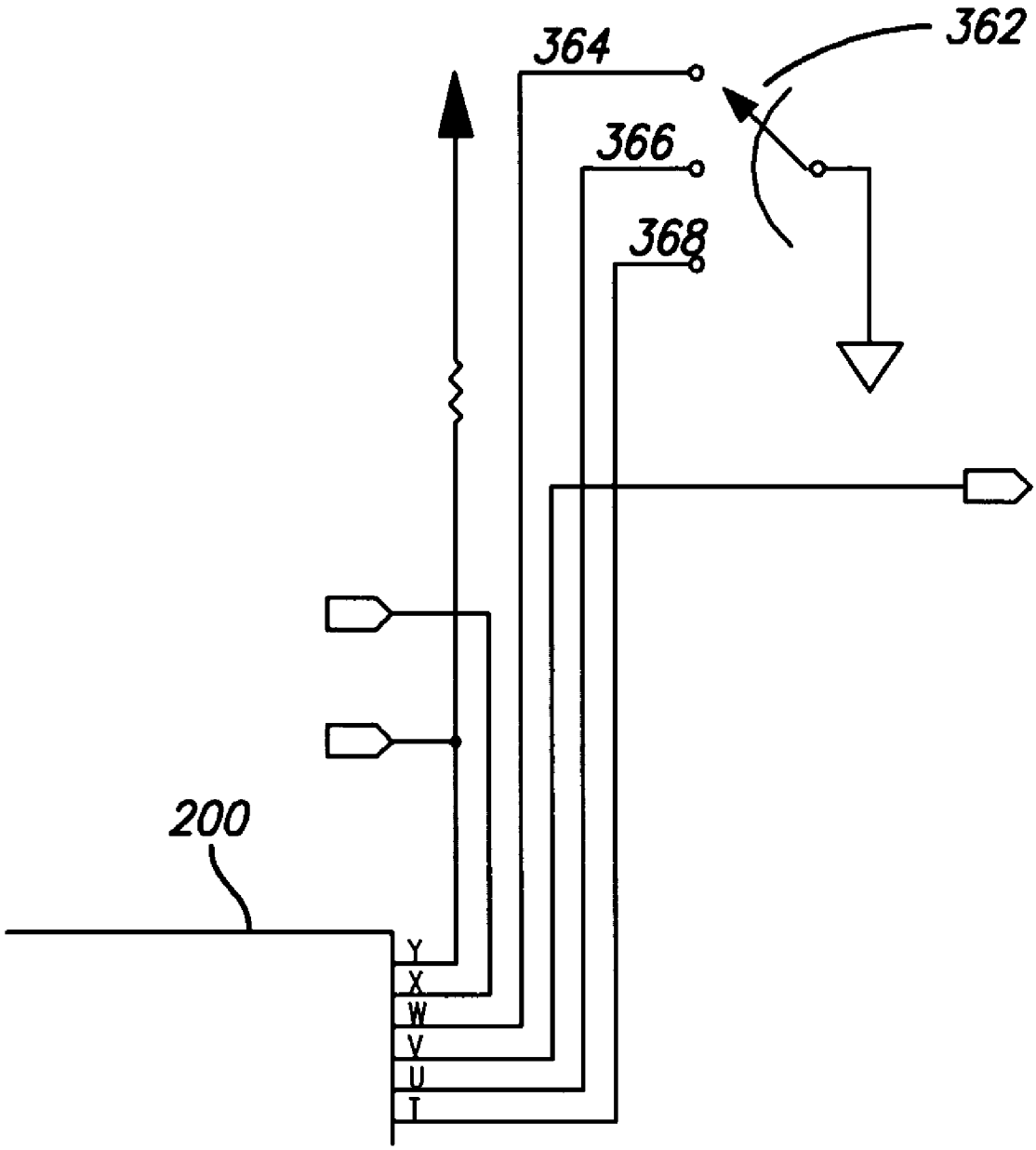
FIG. 18 is a fragmentary portion of the circuit diagram in FIG. 11 showing a portion of the circuit that controls the mode of operation of the circuit relating to the direction of turntable rotation.

With reference to FIG. 18, sub-circuit 218 shows the operation of the three way switch 46, described as allowing selection between three modes of operation of the motor from one set of rotations to the next, each set separated by a pause in rotation. The switch arm 362 may be manually set by a rotary dial to one of three contact positions 364, 366, 368 each connecting to the processor 200 which is configured to provide, depending on the switch position, corresponding instructions to the motor 250 (numeral 90 in the mechanical Figures) on which way to rotate, through sub-circuit 212, and on the number of rotations to make.

Figure 19:
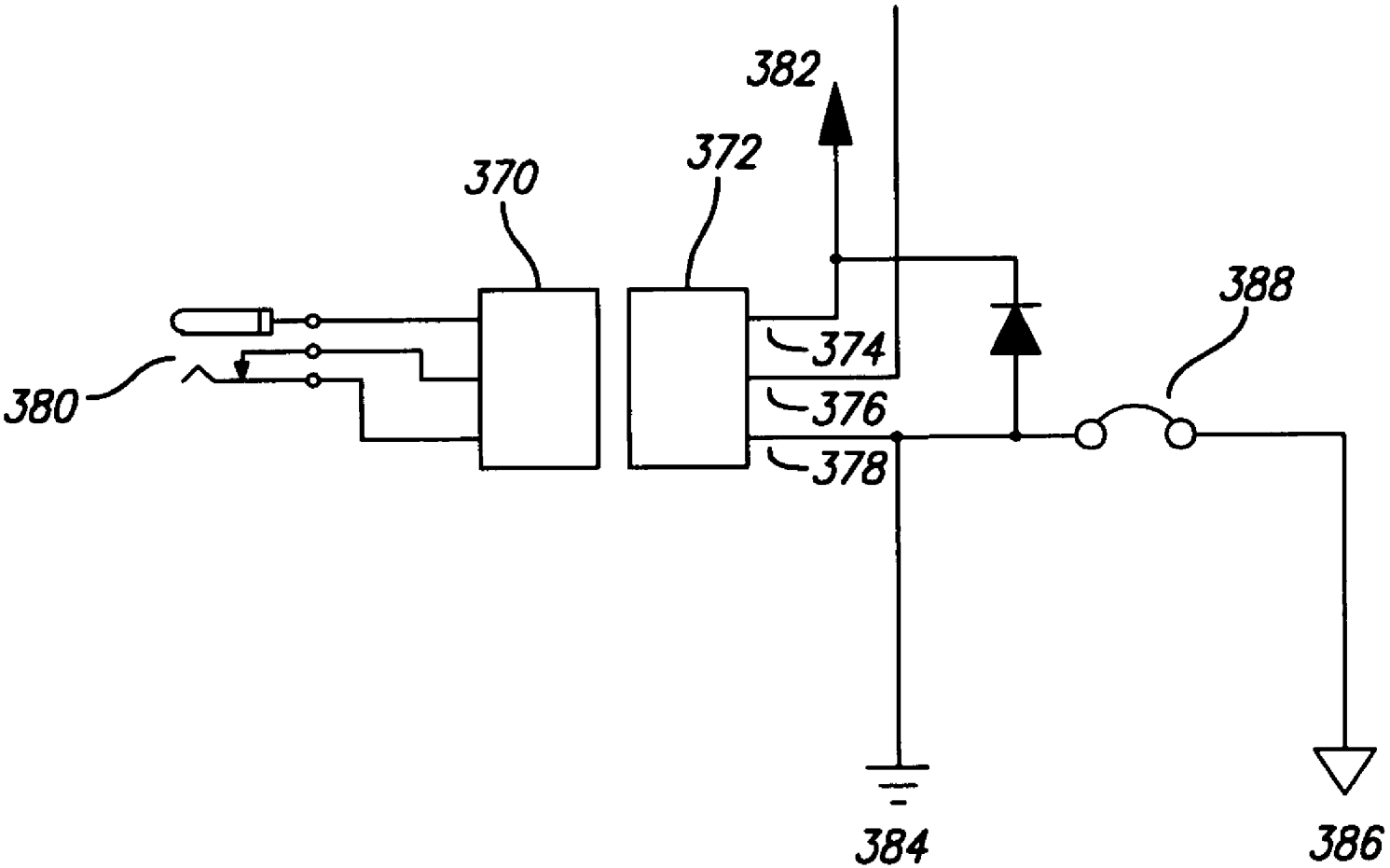
FIG. 19 is a fragmentary portion of the circuit diagram in FIG. 11 showing a portion of the circuit that describes the power source to the circuit.

With reference to FIG. 19, sub-circuit 219 shows the operation of the optional AC/DC adaptor jack, configured to be connected to an adaptor (not shown) for converting a 110 volt or 220 volt AC power source to 3 volt DC. Male and female plug connectors 350 and 352 allow the jack to be selectively disconnected from the circuit when not in use. The jack is designed to interrupt the supply of power to the batteries when the adapter is connected.

Figure 20:
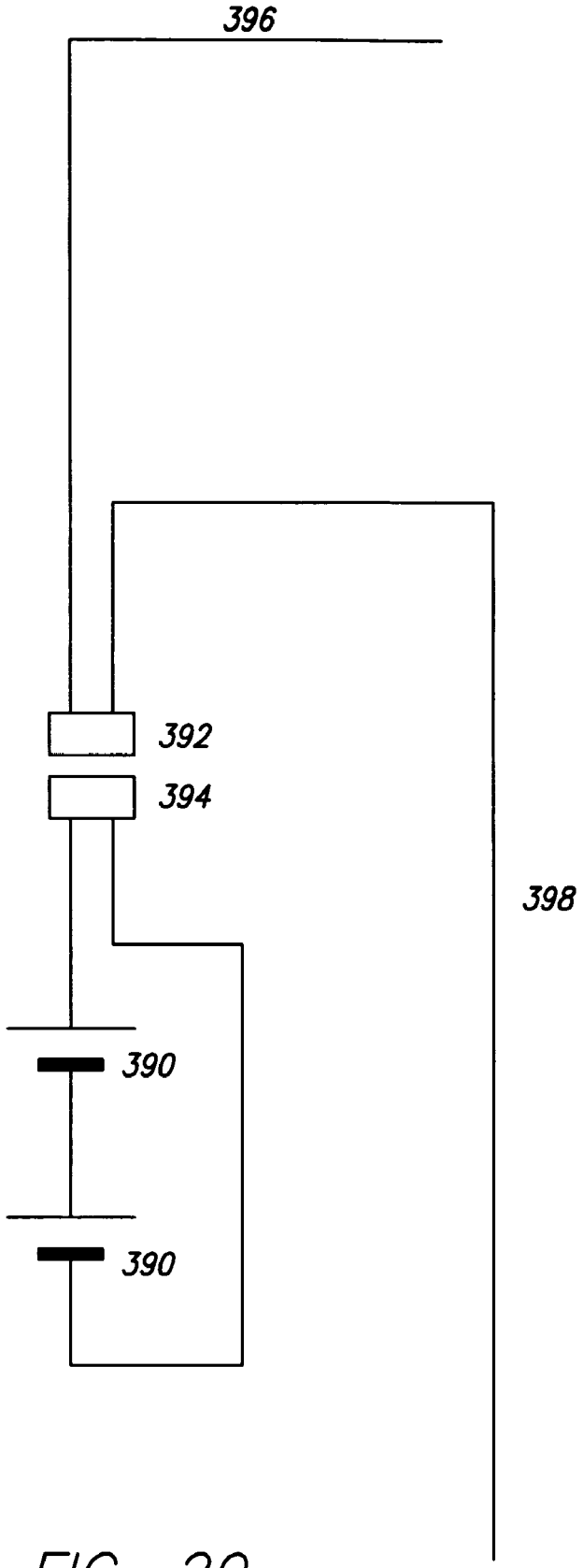
FIG. 20 is a fragmentary portion of the circuit diagram in FIG. 1 showing a portion of the circuit that describes the DC voltage supply to the circuit.

With reference to FIG. 20, sub-circuit 220 shows the DC voltage supply for the circuit 66. Two closed cell batteries 390, such as D-cell flashlight batteries, are connected in series to power the circuit 66 with 3 volts DC through male/female plug connectors 392, 394.

Figure 21:
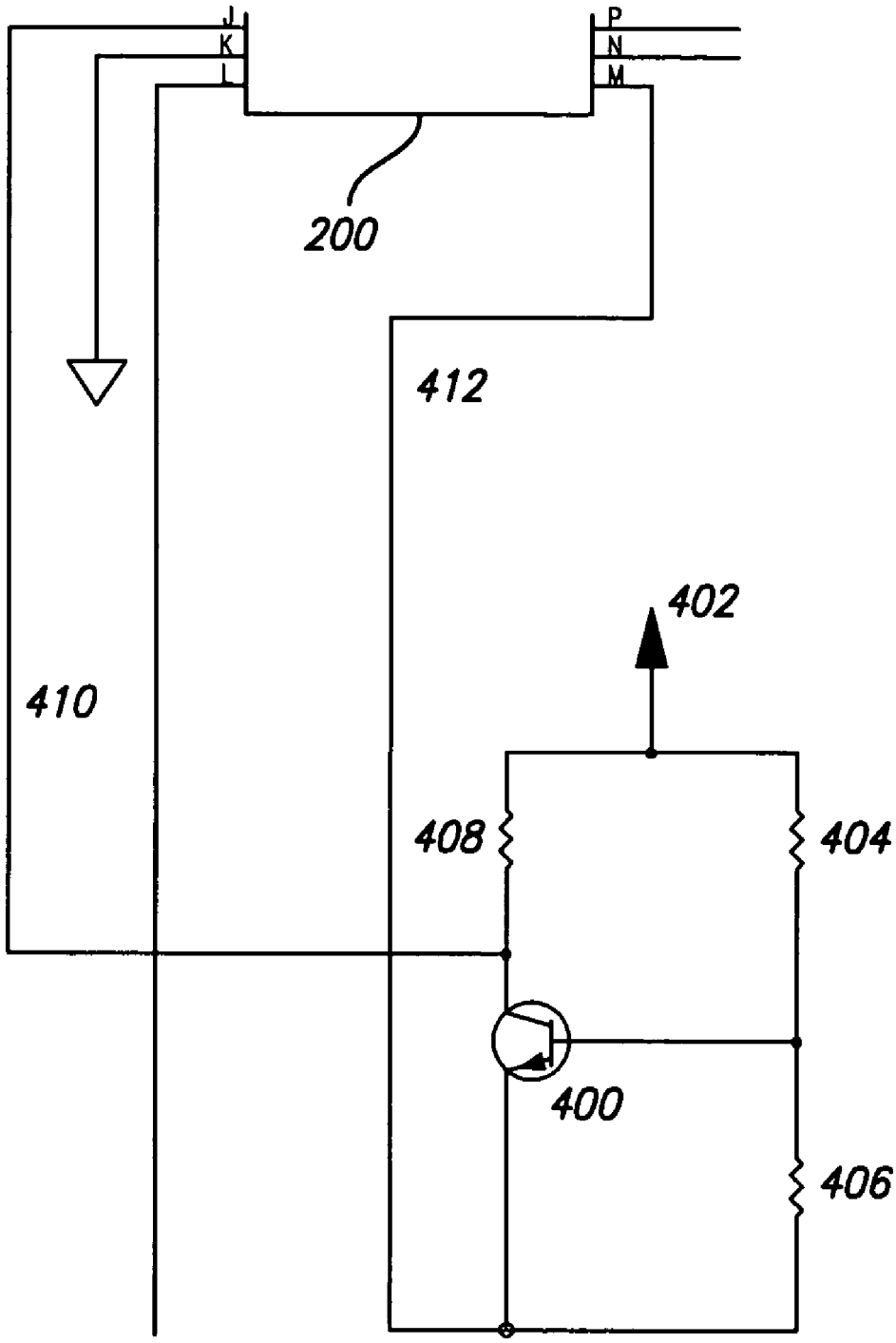
FIG. 21 is a fragmentary portion of the circuit diagram in FIG. 1 showing a portion of the circuit that signals low battery supply.

With reference to FIG. 21, sub-circuit 221 shows operation of the low battery detector. A "low battery" condition at 402 is detected by transistor 400, which sends a low battery indicator signal on line 410 to the microprocessor 200. The microprocessor sends an activation signal to the transistor 294 which controls the low battery warning light 296 in response to the low battery signal on line 410.

Figure 22:
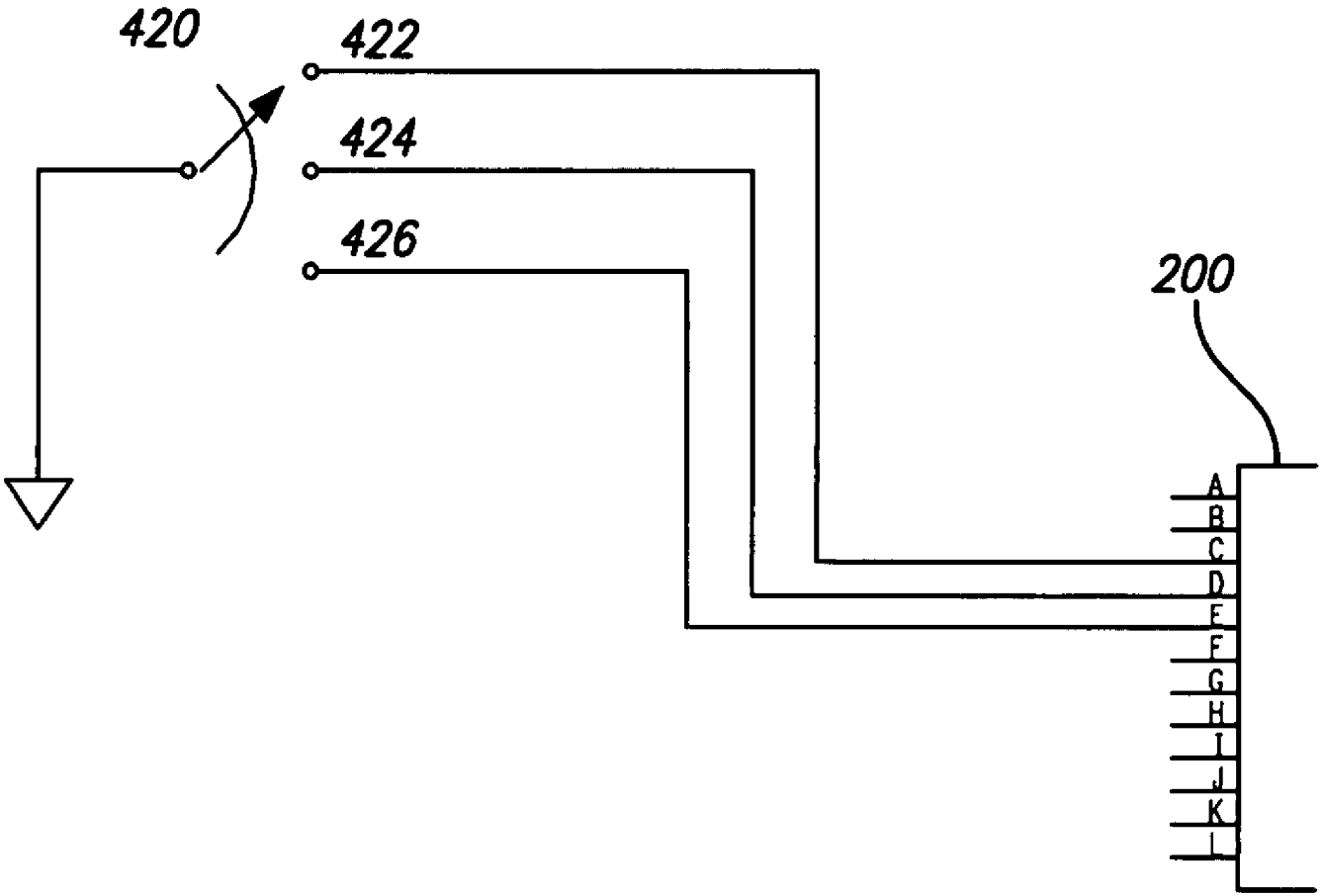
FIG. 22 is a fragmentary portion of the circuit diagram in FIG. 11 showing a portion of the circuit that sets the mode of operation relating to delay before the motor starts turning.
Figure 23:
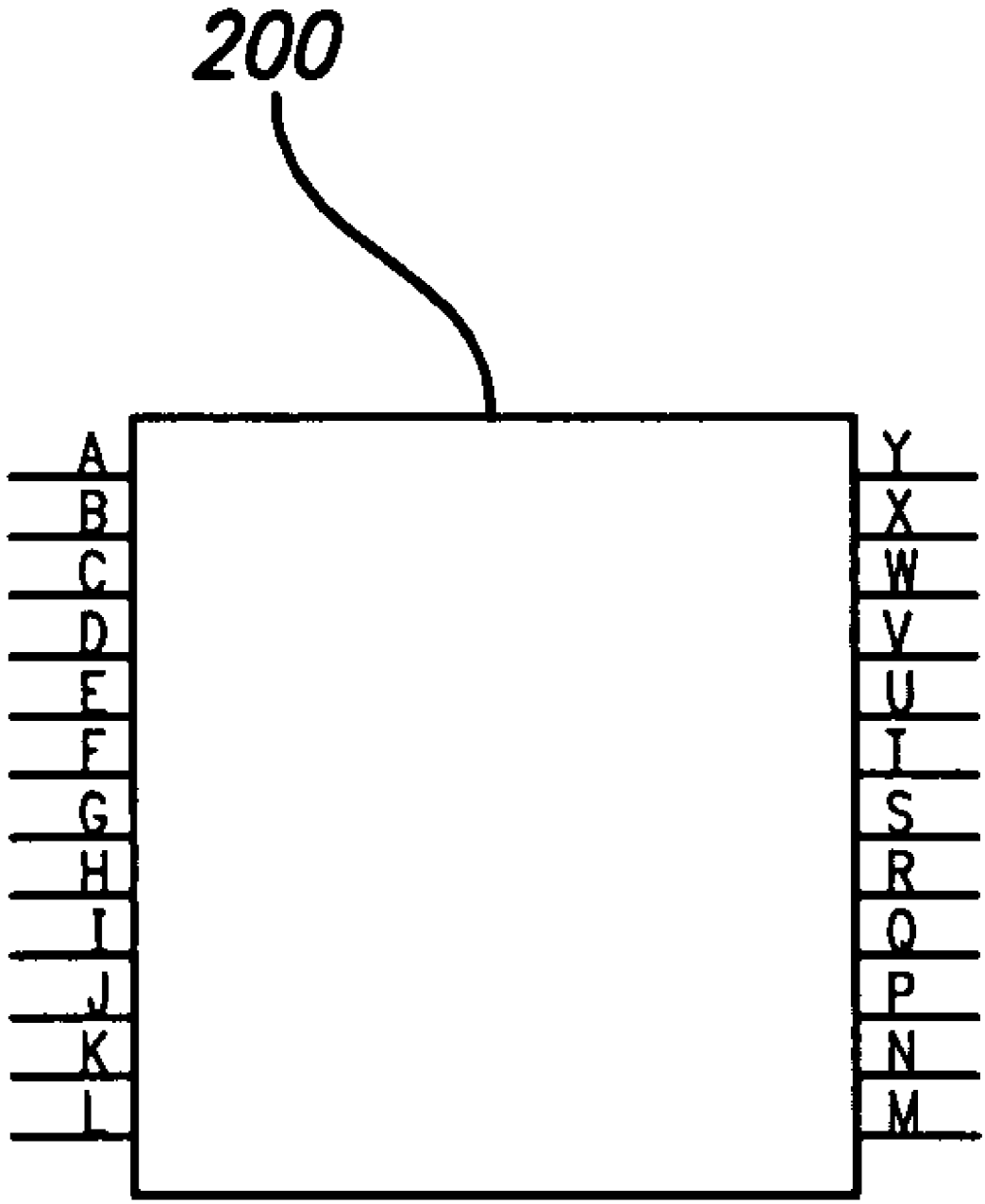
FIG. 23 is an enlarged view of the microprocessor shown in the circuit diagram of FIG. 1, illustrating the pin connections which are further described in the specification.

With reference to FIG. 22, sub-circuit 222 shows the operation of the three way switch 46, described as allowing selection between three modes of operation of the motor, namely "off," "short delay," and "long delay." Switch arm 420 is manually set by rotary dial to one of three contact positions 422, 424, 426, which are interpreted by the processor as "off" 422, activate short delay 424, or activate long delay 426 respectively.

Finally, to further clarify the sub-circuits presented in FIGS. 11-23, the following pin functions are provided by the programming for the microprocessor 200. The letters below indicate the corresponding pin identified in FIG. 23, with the pin's function recited following.

A. Power LED control
B. Warning LED control
C. Timer OFF selection
D Timer 0 Hour selection
E. Timer 12 Hour selection
F. Debug data pin
G. Motor control pin A
H. Motor control pin B
I. Motor control pin C
J. Low battery detect pin
K. Vss pin
L. Photo-interrupter control pim
M. Low battery detect control pin
N. Photo-interrupter detect pin
P. Reset pin
Q. Vdd pin
R. OSC1 pin
S. OSC2 pin
T. Mode C selection
U. Mode B selection V. Debug control pin
W. Mode A selection
X. Motor control pin D
Y. Debug clock pin While the specification describes particular embodiments of the present invention, it will also be apparent to those of ordinary skill that various modifications can be made without departing from the spirit and scope of the invention.

We claim:

1. A watch winder for winding a self-winding watch, comprising:

a turntable configured to rotate a self-winding watch;

a motor configured to rotate the turntable; and an electronic circuit to control the motor, wherein the circuit is configured to commence rotation of the turntable by first introducing a period of delay of sufficient duration to install a watch on the turntable immediately after the circuit is activated.

2. The watch winder of claim 1 wherein the period of delay is between 5 seconds and 15 seconds.

3. The watch winder of claim 2, wherein the period of delay is 10 seconds.

4. The watch winder of claim 1 wherein the period of delay is between 8 hours and 16 hours.

5. The watch winder of claim 4, wherein the period of delay is 12 hours.

6. A watch winder for winding a self-winding watch, comprising;

a turntable configured to rotate a self-winding watch;

a motor configured to rotate the turntable;

an electronic circuit configured to permit either a first mode of operation in which the motor automatically rotates the turntable only after a delay period of first duration, or, a second mode of operation in which the motor automatically rotates the turntable only after a delay period of second duration, the second duration being longer than the first duration; and a selection switch configured to allow selection between either the first or the second mode of operation.

7. The watch winder of claim 6, wherein the first duration is between 5 seconds and 15 seconds, and the second duration is between 8 hours and 16 hours.

8. The watch winder of claim 7, wherein the first duration is 10 seconds and the second duration is 12 hours.

9. A watch winder for winding a self-winding watch, comprising:

a turntable configured to rotate a self-winding watch;

a motor configured to rotate the turntable;

an electronic circuit configured to permit either a first mode of operation in which the motor automatically rotates the turntable for a fixed number of rotations in a first direction, then automatically pauses rotation for a period of time, then automatically continues rotating the turntable in the first direction for the number of rotations, or, a second mode of operation in which the motor automatically rotates the turntable for a certain number of rotations in a first direction, then automatically pauses rotation for a period of time, then automatically continues rotating the turntable in a second direction opposite the first direction for the number of rotations; and a selection switch configured to allow selection between either of the first or the second mode of operation.

10. A watch winder for winding a self-winding watch, comprising:

a turntable configured to rotate a self-winding watch;

a motor configured to rotate the turntable;

an electronic circuit configured to permit either a first mode of operation in which the motor automatically rotates the turntable for a fixed number of rotations in a first direction, then automatically pauses rotation for a period of time, then automatically continues rotating the turntable in the first direction for the number of rotations, or, a second mode of operation in which the motor automatically rotates the turntable for a certain number of rotations in a first direction, then automatically pauses rotation for a period of time, then automatically continues rotating the turntable in a second direction opposite the first direction for the number of rotations, or, a third mode of operation in which the motor automatically rotates the turntable for a certain number of rotations in a second direction opposite the first direction, then automatically pauses rotation for a period of time, then automatically continues rotating the turntable in the second direction for the number of rotations; and a selection switch configured to allow selection between either of the first, the second, or the third mode of operation.

11. A watch winder for winding a self-winding mechanical watch, comprising:

a turntable configured to rotate a self-winding watch;

a motor configured to rotate the turntable continuously over a plurality of rotations; and an electronic circuit configured to detect a rotation made by the turntable, and to keep count of the number of rotations.

12. The watch winder of claim 11, wherein the electronic circuit is further configured to automatically cause the motor to rotate the turntable for a first set of rotations of a certain number, then to pause rotation for a length of time, then to rotate the turntable for a second set of rotations, wherein the circuit is capable of being manually adjusted, prior to use, to variably predetermine the number of rotations and the length of time.

13. The watch winder of claim 12, wherein the first set of rotations is given a direction and the second set of rotations is given a direction, and the circuit is further configured to be manually adjusted, prior to use, to predetermine that the direction of the first set of rotations is the same as the direction of the second set of rotations.

14. The watch winder of claim 13, wherein the circuit is further capable of being manually adjusted, prior to use, to predetermine that the direction of rotation is clockwise.

15. The watch winder of claim 13, wherein the circuit is further capable of being manually adjusted, prior to use, to predetermine that the direction of rotation is anticlockwise.

16. The watch winder of claim 12, wherein the first set of rotations is given a direction and the second set of rotations is given a direction, and the circuit is further configured to be manually adjusted, prior to use, to predetermine that the direction of the second set of rotations is opposite to the direction of the first set of rotations.

17. The watch winder of claim 11, wherein the electronic circuit is further configured to automatically cause the motor to rotate the turntable for a predetermined number of rotations, then to automatically pause rotation, then to automatically continue rotating the turntable.

18. The watch winder of claim 17, wherein the number of rotations is between 100 and 200 rotations, and the pause is between 30 minutes and 90 minutes.

19. The watch winder of claim 18, wherein the number of rotations is 150 rotations in 20 minutes time and the pause is 70 minutes.

20. The watch winder of claim 17, wherein the turntable rotations before the pause are given a direction and the turntable rotations after the pause are given a direction the same as the direction before the pause.

21. The watch winder of claim 20, wherein the rotation direction is clockwise.

22. The watch winder of claim 20, wherein the rotation direction is anti-clockwise.

23. The watch winder of claim 17, wherein the turntable rotations before the pause are given a direction and the turntable rotations after the pause are given a direction opposite the direction before the pause.

24. The watch winder of claim 17, wherein the circuit is further configured to terminate rotation of the turntable for a period of time after between 600 and 1200 rotations.

25. The watch winder of claim 24, wherein the circuit is further configured to terminate rotation of the turntable for a period of time after 900 rotations.

26. The watch winder of claim 24, wherein the period of time is 15 hours.

27. The watch winder of claim 17, wherein the circuit is further configured to terminate rotation of the turntable for a period of time after between 50 and 2500 rotations.

28. The watch winder of claim 27, wherein the period of time is 15 hours.

29. The watch winder of claim 11, wherein the electronic circuit is further configured to pause the rotation of the turntable after a predetermined number of rotations.

30. The watch winder of claim 29, wherein the electronic circuit is further configured to resume rotation of the turntable after a pause of time.

31. The watch winder of claim 30, wherein the electronic circuit is configured to give the rotation of the turntable before the pause a first direction, and the rotation of the turntable after the pause a second direction opposite the first direction.

32. The watch winder of claim 29, wherein the predetermined number of rotations is between 50 and 2500 rotations.

33. The watch winder of claim 29, wherein the electronic circuit is capable of being manually adjusted by the user to variably alter and predetermine the number of rotations.

34. The watch winder of claim 29, wherein the electronic circuit is capable of being manually adjusted by the user to variably alter and predetermine the duration of the pause.

35. The watch winder of claim 11, wherein the turntable includes a light reflective film adhered to its surface for detecting rotations made by the turntable.

36. The watch winder of claim 11, wherein the electronic circuit includes an infrared sensor for counting the number of rotations made by the turntable.

37. The watch winder of claim 11, further comprising a housing having at least two cantilever supports configured to provide a stabilizing force on the turntable.

38. The watch winder of claim 37, wherein the cantilever supports include annular resilient bearings.

39. The watch winder of claim 11, further comprising a first gear wheel fixed to the turntable; and multiple second reduction gear wheels positioned between the motor and the first gear wheel, to transfer power from the motor to the turntable.

40. the watch winder of claim 11, further comprising a removable cuff for holding a watch on the turntable, the cuff having:

a generally cylindrical core made of open cell foam, the core having with a front end and a back end and being axially compressible from the front end to the back end;

a first relatively rigid end plate positioned at the front end and a second relatively rigid plate positioned at the back end; and a porous material covering the core and the first and second plates, said material being porous to the passage of air between the core and the environment.

41. The watch winder of claim 11, further comprising a removable cuff for holding a watch on the turntable, the cuff having:

a generally cylindrical shape with a front end and a back end and being axially compressible from the front end to the back end.

42. The watch winder of claim 11, wherein the electronic circuit is further configured to automatically stop rotation for 15 hours after a predetermined total number of rotations has been completed.

43. The watch winder of claim 42, wherein the predetermined total number of rotations is between 600 and 1200 rotations.

44. The watch winder of claim 11, wherein the electronic circuit is further configured to rotate the turntable for a predetermined number of rotations and then automatically stop for a period of time representing one rotation cycle, and to automatically repeat said rotation cycle multiple times until a predetermined total number of rotations has been completed.

45. The watch winder of claim 11, wherein the electronic circuit is further configured to rotate the turntable for a predetermined number of rotations and then automatically stop for a first period of time representing one rotation cycle, and to automatically repeat said rotation cycle multiple times before automatically stopping for a second period of time, the second period of time being longer than the first period of time.

46. The watch winder of claim 45, wherein the total time taken from the start of rotation to the end of second period of time is about 24 hours.

47. The watch winder of claim 44, wherein the electronic circuit is further configured to automatically terminate rotation for 15 hours after the predetermined total number of rotations has been completed.

48. A method for controlling a watch winder having a mechanism configured to wind a self-winding mechanical watch when the mechanism is moved, comprising:

activating the watch winder;

introducing a period of delay wherein the mechanism is not moved;

placing a watch in the watch winder during the period of delay; and automatically moving the mechanism to wind the watch, after the period of delay.

49. The method of claim 48, wherein the period of delay is between 5 and 15 seconds.

50. The method of claim 49, wherein the period of delay is 10 seconds.

51. The method of claim 48, wherein the period of delay is between 5 and 15 hours.

52. The method of claim 48, wherein the period of delay is 12 hours.

53. The method of claims 48, further comprising placing a watch in the watch winder before activating the watch winder.

54. A watch winder for winding a self-winding watch, comprising:

a turntable configured to rotate a self-winding watch;

a motor configured to rotate the turntable; and an electronic circuit to control the motor, wherein the circuit is configured to commence rotation of the turntable by introducing a period of delay of sufficient duration to install a watch on the turntable after the circuit is activated but prior to commencement of a watch winding program.

55. The watch winder of claim 54, wherein the duration of the delay period is user selectable.

56. The watch winder of claim 54, wherein the duration of the delay period is user selectable from a plurality of preprogrammed delay times stored in a memory.

57. The watch winder of claim 54, wherein the duration of the delay period is variable.

* * * * *

UNITED STATES PATENT AND TRADEMARK OFFICE

CERTIFICATE OF CORRECTION

PATENT NO. : 7,575,367 B2
APPLICATION NO. : 10/845463
DATED : August 18, 2009
INVENTOR(S) : Simon P. Wolf, V et al.

It is certified that error appears in the above-identified patent and that said Letters Patent is hereby corrected as shown below:

Column 4, lines 11, 16, 25, 28 and 34, change "FIG. 1" to --FIG. 11--.

Column 13, line 61, change "the watch winder of claim 11" to --The watch winder of claim 11--.

Column 14, line 59, change "48" to --51--.

Signed and Sealed this
Fourth Day of September, 2012

David J. Kappos

David J. Kappos
*Director of the United States Patent and Trademark Office*